US005966100A

United States Patent [19]

Podger

[11] Patent Number: 5,966,100

[45] Date of Patent: Oct. 12, 1999

[54] QUADRUPLE-DELTA ANTENNA STRUCTURE

[76] Inventor: James Stanley Podger, 55 Gradwell Dr., Scarborough, Ontario, Canada, M1M 2N1

[21] Appl. No.: 08/813,320

[22] Filed: Mar. 10, 1997

[30] Foreign Application Priority Data

Apr. 26, 1996 [CA] Canada ..... 2175095

[51] Int. Cl.[6] ..... H01Q 11/12

[52] U.S. Cl. ..... 343/742; 343/792.5; 343/808; 343/866

[58] Field of Search ..... 343/742, 741, 343/866, 867, 797, 792.5, 890, 806, 808, 811, 812, 813, 814, 816; H01Q 11/12

[56] References Cited

U.S. PATENT DOCUMENTS

| | | | |
|---|---|---|---|
| D. 213,375 | 2/1969 | Habig | D26/14 |
| 2,510,290 | 6/1950 | Masters | 343/795 |
| 2,537,191 | 1/1951 | Moore | 250/33.67 |
| 3,108,280 | 10/1963 | Mayes | 343/792.5 |
| 3,210,767 | 10/1965 | Isbell | 343/792.5 |
| 3,268,899 | 8/1966 | Walden | 343/741 |
| 3,434,145 | 3/1969 | Wells | 343/726 |
| 3,618,111 | 11/1971 | Vaughan | 343/915 |
| 3,646,566 | 2/1972 | Neff | 343/808 |
| 4,745,725 | 5/1988 | Onoda | 52/646 |

OTHER PUBLICATIONS

Kraus, John D., "A Small But Effective 'Flat Top' Beam," *Radio*, Mar. 1937, pp. 56–58.

Orr, William I., "Loop Configuration," *Radio Handbook*, 23rd ed. (Indianapolis: Howard W. Sams & Co., 1987), pp. 22–11/12.

Kraus, John D., "Twin–Three Flat–Top Beam Antenna," *Radio*, Nov. 1939, pp. 10–14 and pp. 81–83.

Carrel, Robert L., Analysis and Design of The Log–Periodic Dipole Antenna, University of Illinois, Antenna Laboratory Technical Report 52.

Podger, J. S., Analysis Results, Double Delta, (No Date Provided).

Podger, J. S., Analysis Results, Quadruple Delta (No Date Provided).

Sykes, B., "The Skeleton Slot Aerial System," *The Short Wave Magazine*, Jan. 1955, pp. 594–598.

Davey, W. W., "Try a Bi–Loop Antenna," *73 Magazine*, Apr. 1979, p. 58.

Hawker, J. Patrick, "Technical Topics, Double–Delta Aerials for VHF and UHF," *Radio Communications*, Jun. 1969, p. 396.

*Primary Examiner*—Hoanganh Le
*Assistant Examiner*—Tho Phan

[57] ABSTRACT

An antenna element is disclosed that is a set of approximately coplanar conductors that form four approximately triangular conductors, each of which has a perimeter of approximately one wavelength. Three parallel conductors are the central part and the two outer parts. Joining these three parallel conductors, there are four diagonal conductors, of approximately equal length, that connect each end of the central parallel conductor to the opposite end of each of the outer parallel conductors. Where these diagonal conductors cross, they do not touch. Compared to previous antennas constructed for the same purposes, antennas constructed with these antenna elements can yield more directivity, particularly in the principal H plane, or more bandwidth. Several applications of such antenna elements in various arrays also are disclosed.

48 Claims, 8 Drawing Sheets

Fig. 2
Prior Art
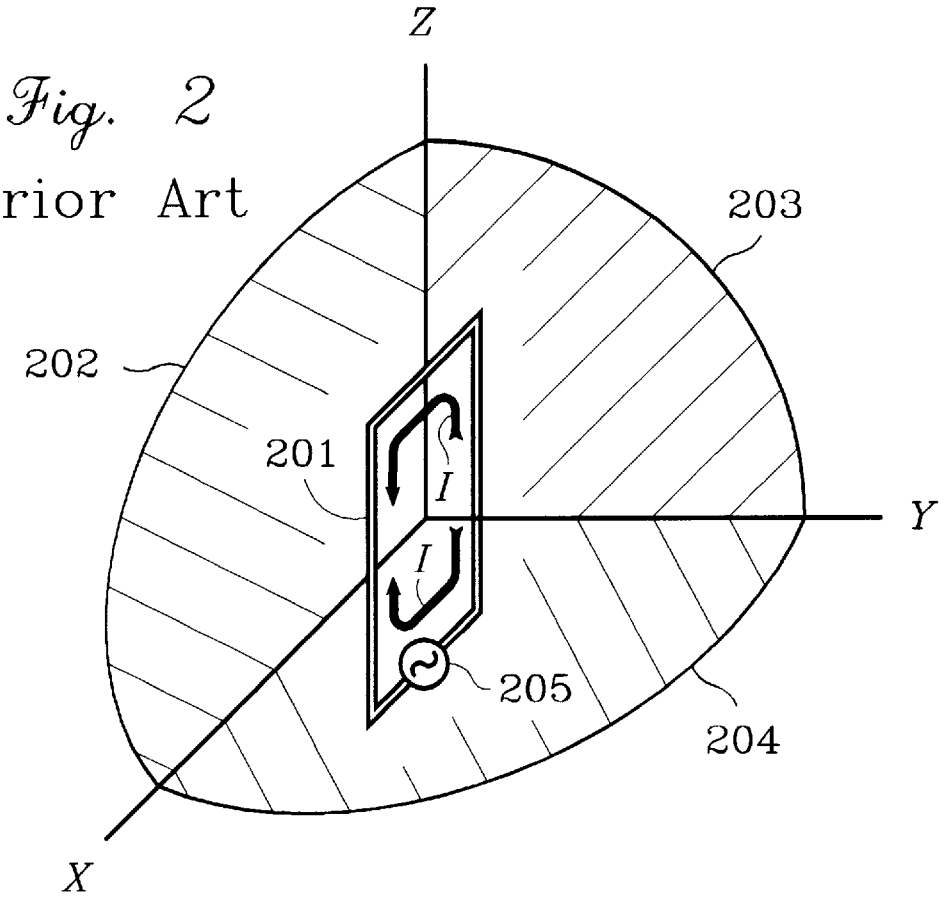
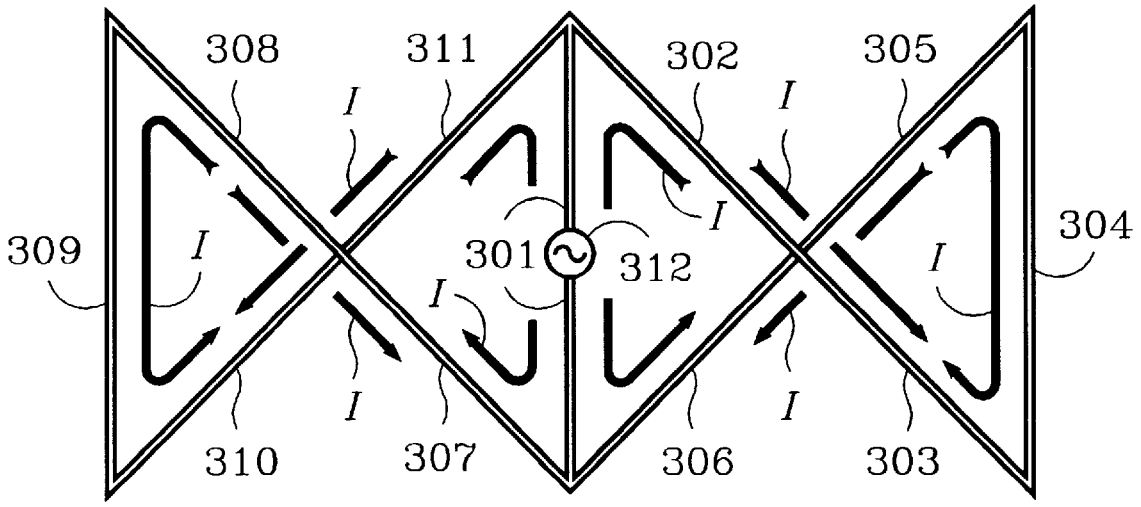
Fig. 3

QUADRUPLE-DELTA ANTENNA STRUCTURE

FIELD OF THE INVENTION

This invention relates to antenna elements, specifically antenna elements that are sets of loops one-wavelength in perimeter. This is the U.S. version of Canadian patent 2,175,095. Such antenna elements can be used alone or in combinations to serve many antenna needs. One object of the invention is to achieve a superior transmitting and receiving ability, the gain, in some desired direction. Particularly, an object is to enhance that ability at elevation angles close to the horizon. Another object is to decrease the transmitting and receiving ability in undesired directions. Yet another object is to produce antennas that operate satisfactorily over greater ranges of frequencies.

Previous disclosures have shown that loops of conductors approximately one wavelength in perimeter yield advantages over more traditional straight conductors approximately one-half wavelength long. Particularly, these loops produce more gain over wider ranges of frequencies. Since the 1950's, it has been disclosed that pairs of such loops, particularly triangular loops, produce even more gain and reduce radiation in undesired directions even more. This disclosure presents the merit of antenna elements having four triangular loops. Those antenna elements will hereinafter be called quadruple-delta antenna elements.

LIST OF DRAWINGS

The background of this invention as well as the objects and advantages of the invention will be apparent from the following description and appended drawings, wherein:

FIG. 2 illustrates the conventional principal planes passing through a rectangular loop antenna;

FIG. 3 illustrates the front view of the basic quadruple-delta antenna element, which is the subject of this disclosure;

PRIOR ART—SINGLE LOOPS

Figure 1A:
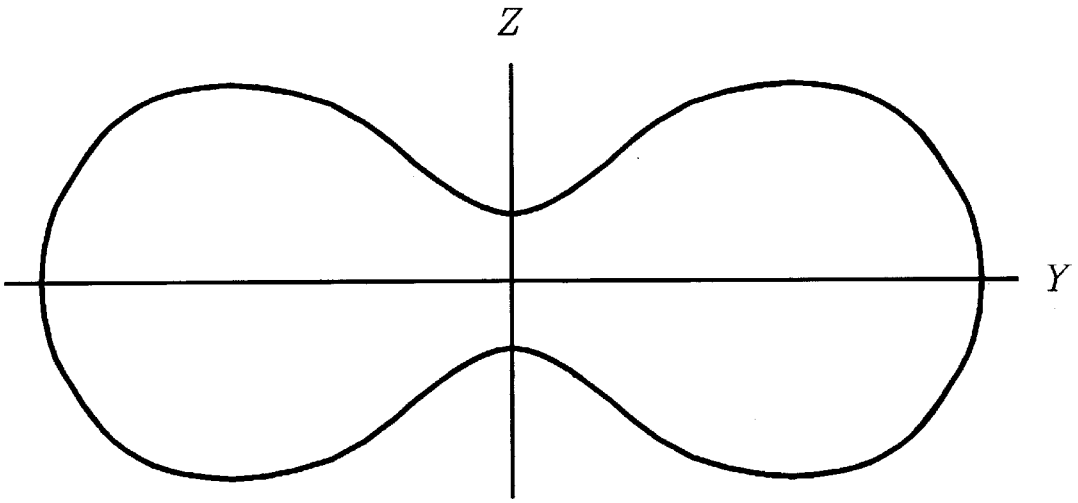
Prior Art Fig. 1A
FIGS. 1A, 1B and 1C illustrate some possible simplified radiation patterns of antennas.

The have been many antennas proposed in the literature based on loops approximately one wavelength in perimeter, but there seems to be less discussion of the reasons why some antenna elements are better than other ones. In order to understand the present disclosure, it is important to review and evaluate these previous antenna elements. The following discussion will deal with the merits of loops, pairs of loops, and pairs of triangular loops. Then it will be possible to show the merit of sets of four triangular loops.

The classical elementary antenna element, called a half-wave dipole, is a straight conductor approximately one-half wavelength long. One of its disadvantages is that it transmits or receives equally well in all directions perpendicular to the conductor. That is, in the transmitting case, it does not have not much gain because it wastes its ability to transmit in desired directions by sending signals in undesired directions. Another disadvantage is that it occupies a considerable space from end-to-end, considering that its gain is low. A third disadvantage is that it is susceptible to noise caused by precipitation. Yet another disadvantage is that if a high transmitter power were applied to it, in some climatic conditions, the very high voltages at the ends of the conductor could ionize the surrounding air producing corona discharges. These discharges could remove material from the conductor ends and, therefore, progressively shorten the conductors.

A worth while improvement has been achieved by using loops of various shapes that are one-wavelength in perimeter. Some examples are in the U.S. Pat. Nos. 2,537,191 of Clarence C. Moore, 3,268,899 of J. D. Walden, and Des. 213,375 of Harry R. Habig. Mathematical analysis shows that circular loops are the best of the common shapes and the triangles are the worst. However, the differences are small.

Although the other advantages of these loops are important, the gain advantage is most significant to this discussion. To illustrate this advantage, FIG. 2 shows the rectangular version of them (201). The wide arrows in this diagram and FIG. 3 represent some aspects of the currents flowing in the conductors. All of these arrows attempt to denote the current patterns as the standing waves vary from each null through the maximum to the following null in each electrical half-wave of the current paths. At the centers of these arrows, the currents would reach the maxima for the paths denoted by these particular arrows. Where the arrowheads or arrow tails face each other, there would be current nulls, and the currents immediately on either side of these points would be flowing in opposite directions. However, beside these indications of where the current maxima and minima would be located, not much else is denoted by these arrows. Particularly, one should not assume that the currents at the centers of all the current paths are of equal magnitude and phase as each other even though all of these currents are denoted as I. In general, the interaction of the currents will produce a complicated amplitude and phase relationship between these currents. Nevertheless, it would be unusual if the phase of these currents would be more than 90 degrees away from the phase implied by the direction of the arrows. That is, the phase would not be so different from an implied zero degrees that the arrows should be pointed in the opposite direction because the phase is closer to 180 degrees than to zero degrees.

Of course, these current directions are just the directions of particular currents relative to the directions of other currents. They obviously are all alternating currents that change directions according to the frequency of operation.

As indicated by the generator symbol (205) in FIG. 2, if energy were fed into one side of the loop, maxima of current standing waves would be produced at this feeding point and at the center of the opposite side of the loop, because it is a one-wavelength loop. The current minima and voltage maxima are half-way between these current maxima. One result of this current distribution is that the radiation is not uniform in the YZ plane (203). This is because there are two conductors carrying the maximum current, the top and bottom of the loop in FIG. 2, which are perpendicular to that plane. Although these two currents are approximately equal in amplitude and phase, because of the symmetry, their fields would add in phase only in the direction of the Y axis. Because the distances from those two conductors to any point on the Y axis are equal, the propagation delays are equal. In other directions, the distances travelled to any point would be different for the two fields, hence the fields would not add in phase. The result is that the radiation pattern in that plane is similar in shape to that illustrated by FIG. 1A. Hereinafter, this plane (203) will be called the principal H (magnetic field) plane, as is conventional.

Therefore, this antenna element has gain relative to a half-wave dipole in the direction perpendicular to the plane of the loop, which is the direction of the Y axis in FIGS. 1 and 2. Also because of this nonuniform pattern, if plane 203 were vertical (horizontal polarization), signals transmitted at vertical angles near the horizon would be somewhat stronger. This factor gave this antenna element the reputation for being better if a high supporting tower were not available. Antennas located near the ground usually produce weak signals near the horizon.

This ability to produce stronger signals near the horizon is important in and above the very-high frequencies because signals generally arrive at low vertical angles. Fortunately, it is not difficult to put signals near the horizon at such frequencies, because it is the height in terms of wavelengths that matters and, with such short wavelengths, antennas easily can be positioned several wavelengths above the ground. It also is important to put signals near the horizon at high frequencies because long-distance signals arrive at angles near the horizon and they usually are the weaker signals. This is more difficult to achieve, because the longer wavelengths determine that antennas usually are close to the ground in terms of wavelengths.

Another advantage of this kind of antenna element is that it is only one-half as wide as the half-wave dipole and, therefore, it can be placed in smaller spaces. On the other hand, because its high-current paths are shorter than those of a half-wave dipole, they produce a slightly broader radiation pattern in the plane that is perpendicular to both the plane of the antenna (202) and the principal H plane (203). Hereinafter, in this description and the attached claims, this will be called the principal E (electric field) plane (204), as is conventional. This broader pattern reduces the antenna gain to a relatively small extent. The net effect is that these loops do not have as much an advantage in satellite applications, where sheer gain may be most important, as they have in terrestrial applications, where performance at low elevation angles may be most important.

PRIOR ART—PAIRS OF LOOPS

More significant advances have been made using closely spaced pairs of loops. Examples of them have been disclosed by B. Sykes in *The Short Wave Magazine* of January, 1955, D. H. Wells in U.S. Pat. No. 3,434,145, and W. W. Davey in 73 *Magazine of April,* 1979. But mathematical analysis reveals that the best combination so far is John Pegler's pair of triangular loops, with one corner of each loop at the central point, which was disclosed by Patrick Hawker in *Radio Communications* of June, 1969. Mr. Hawker reported that Mr. Pegler had used Yagi-Uda arrays of such antenna elements for "some years" on amateur radio and broadcast television frequencies. Because Mr. Pegler called them "double-delta" antenna elements, hereinafter that name will be used.

Because of the interaction of the fields, these combinations of two loops modify the magnitude and phase of the currents to an extent that makes the combination more than just the sum of two loops. The result is that the dimensions can be chosen so that the field patterns in the principal H plane can be like FIG. 1B or even like FIG. 1C. Such dimensions not only give more gain by narrowing the major lobe of radiation but, particularly in the case of FIG. 1B, the radiation in undesired directions also can be greatly reduced. In addition, some arrays of such two-loop combinations can reduce the radiation to the rear to produce very desirable unidirectional radiation patterns in the principal H plane. On the high-frequency bands, such radiation patterns can reduce the strength of high-angle, short-distance signals being received so that low-angle, long-distance signals can be heard. For receiving weak very-high-frequency or ultra-high-frequency signals bounced off the moon, for another example, such a pattern will reduce the noise being received from the earth or from stars that are not near the direction of the moon. Also, for communications using vertical polarization on earth, so that the principal H plane is horizontal, such radiation patterns would reduce the interference from stations located in horizontal directions different from that of the desired station.

The gain advantage of these triangular loops seems to be based on the need to separate the high-current parts of the antenna element by relatively large distances. As it is with combinations of Yagi-Uda arrays of dipoles, for example, there is a requirement to space individual antennas by some minimum distance in order to achieve the maximum gain from the combination. The spacing of the high-current parts achieved by the rectangular loops of Sykes and Wells is less than it could be because, not only are the outer sides high-current active parts, but so also is the central side. Davey's diamonds separate the high-current outer parts to a greater degree, but that shape is not the best available. Triangular loops waste less of the available one-wavelength loop perimeter in placing the outer high-current parts far from the central point. Triangular loops also greatly reduce the radiation from the central high currents because they are flowing in almost opposite directions into and out of the central corner. Therefore, as far as combinations of two loops approximately one wavelength in perimeter are concerned, these triangular shapes seem to produce the maximum gain available so far.

THE PRESENT INVENTION

Since this prior art of pairs of triangular loops performs well, it is reasonable to investigate combinations of more triangular loops. Because it is usually desirable to have the maximum gain in the direction perpendicular to the plane of the loops, that requirement would logically restrict the investigation to antenna elements that are symmetrical around the central point of the antenna element. And since single triangles are not symmetrical, such investigations would logically be restricted to even numbers of triangles, rather than odd numbers of triangles.

FIG. 3 shows such a combination of four triangular loops, which is the basic antenna element of this disclosure. In this diagram, and in most of the following ones, the parts are numbered according to their functions as the sides of triangles. For example, a single piece of tubing may be used to form parts 310, 311, 302 and 303, but this tube would function as four triangle sides and, therefore, it has been given four part numbers so that these functions can be noted separately. Part 301 may be one conductor or two conductors separated by the feed point, which is represented by the generator symbol, part 312. But, because part 301 functions as one side of the triangles, it has been given just one part number. The exception to this policy is in FIG. 11. Because there is a need to refer to each half of the central parts, they are given separate numbers in that diagram.

The antenna element of FIG. 3 has three parts, 309, 301 and 304, that are approximately parallel to each other. Hereinafter in this description and the attached claims, these parts will be called the parallel conductors. In the claims, the central part will be called the proximal approximately parallel conductor and the outer parts will be called the distal approximately parallel conductors. Each end of the central parallel conductor is connected to the opposite ends of the outer parallel conductors by pairs of parts. For example, parts 311 and 310 connect the top end of part 301 to the bottom end of part 309. Likewise, parts 307 and 308 connect the bottom end of part 301 to the top end of part 309. Hereinafter in this description and the attached claims, these connecting parts will be called the diagonal conductors. Note that where these diagonal conductors cross, there is no connection. That is, there is a single current path from part 301, through parts 302, 303, 304, 305, and 306, and back to part 301. Because the feed point is in the center of part 301 and the triangles are approximately one wavelength in perimeter, current maxima are in the centers of the parallel conductors and near the places where the diagonal conductors cross. However, because it usually is desirable to have the central parallel conductor of a different length than the length of the outer parallel conductors, the current maxima on the diagonal conductors usually would not be exactly at the places where the diagonal conductors cross and the crossing point would not be exactly half-way between the parallel conductors.

The parallel conductors in FIG. 3 are the principal radiating parts because they carry current maxima flowing approximately in the same direction at any one time and, therefore, the fields that their currents produce approximately assist each other in the direction perpendicular to the plane of the loops. Because of the symmetry of the antenna element, it is apparent that parts 304 and 309 will have approximately equal currents, but it should not be assumed that the current in part 301 will be the sum of those other two currents. However, the current in that central part usually will be larger than the current in either outer part.

The diagonal conductors will have current maxima near the places where they cross, but their effect on the total radiation will be less than the effect of the currents in the parallel conductors. Their radiating effect in the directions up or down in FIG. 3, would be small because the current components of the diagonal conductors perpendicular to those directions oppose each other. For the radiation directions to the left or right in FIG. 3 or in the directions perpendicular to the plane of the loops, the effective current components are perpendicular to those directions. That is, they are the components flowing up and down in the diagram. These effects add to some extent, but since the current paths are not parallel, the effect of these current components is relatively small. Therefore, it is a rough but reasonable approximation to consider that the significant parts of this antenna element are the three parallel conductors.

Figure 1B:
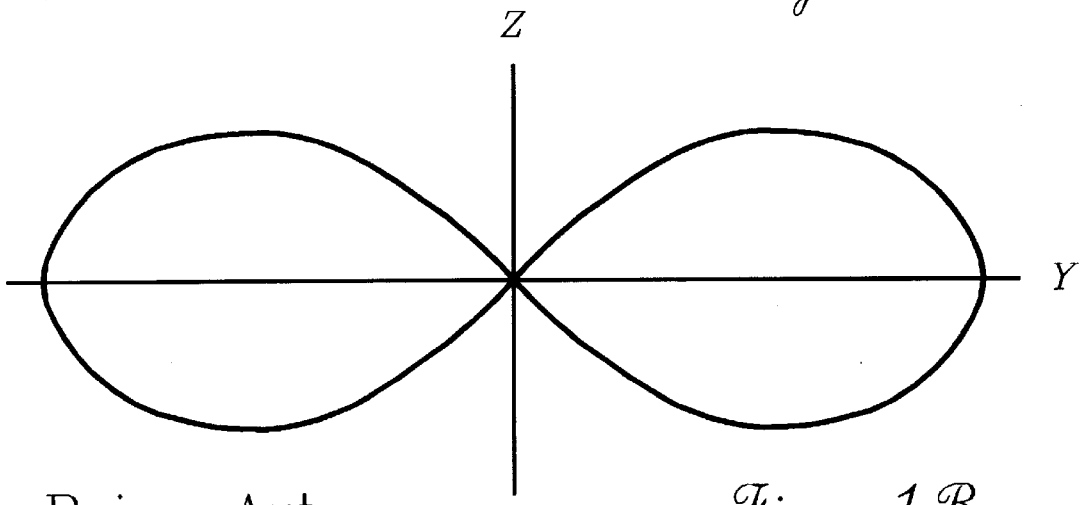
Prior Art Fig. 1B
Figure 1C:
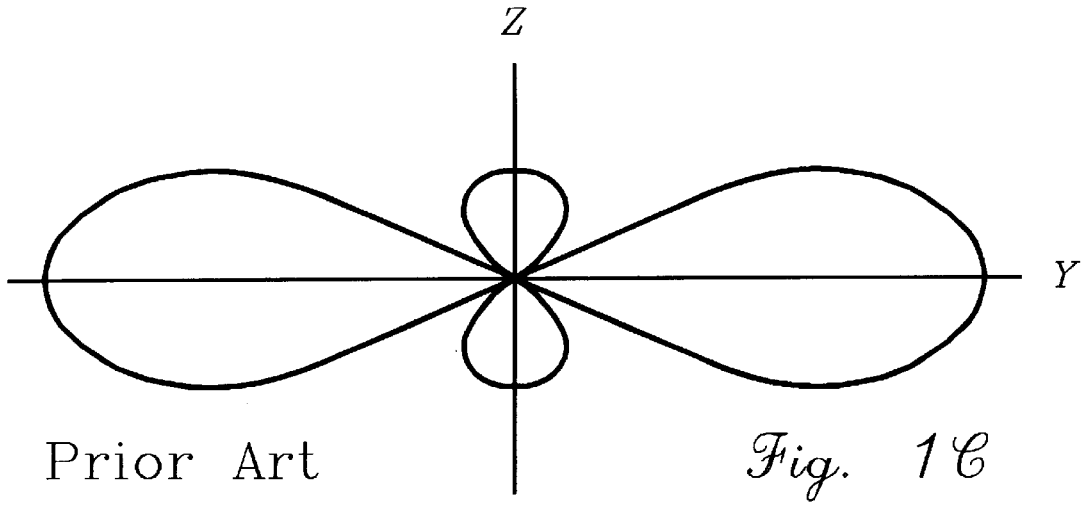
Prior Art Fig. 1C

The best dimensions for such an antenna element depend on the particular antenna needs. Within the restriction that the triangles should be about an electrical wavelength in perimeter, there are several combinations of dimensions that might be useful. Sometimes the maximum gain is necessary; sometimes the minimum radiation in undesired directions is more important. Often a radiation pattern similar to that of FIG. 1B is desirable, but quadruple-delta antenna elements usually will not produce simply a null at the middle of the pattern. A more likely result is three tiny lobes of radiation placed where the null is shown in FIG. 1B.

In order to have the maximum radiation perpendicular to the plane of the loops, it usually is desirable that parts 304 and 309 should have equal lengths to maintain the symmetry around the central point. The central part, 301, is not restricted in that way. In most cases, it is desirable to make the central parallel conductor longer than the outer parallel conductors. However, if the antenna element were such that there were relatively large distances between the parallel conductors and the parallel conductors were relatively short, it usually would be desirable to make the central parallel conductor shorter than the outer parallel conductors.

It also should be realized that the best dimensions for a single quadruple-delta antenna element may not be the best dimensions for individual quadruple-delta antenna elements in an array. The interaction between the various parts of an array will change the currents in amplitude and phase so that the best dimensions must be found for each array. The operating frequency, bandwidth, and cross-sectional dimensions needed for mechanical strength also will change the best dimensions for the parts in an individual antenna array. Of course, this need to find the best dimensions for a particular application applies to arrays of dipoles or single loops as well. A logical design procedure is to find the approximate dimensions with a computer design program and then to make the final adjustments to the antenna at an antenna range.

However, some guidance can be obtained from dimensions that have been found satisfactory in some cases. For example, one might start with the following dimensions for one single quadruple-delta antenna element that had the FIG. 1B type of pattern. The distance between the parallel conductors was 0.68 free-space wavelengths, the central parallel conductor was 0.38 free-space wavelengths long, and the outer parallel conductors were 0.33 free-space wavelengths long. Of course, the actual design frequency and the cross-sectional dimensions of the conductors would influence these lengths. If high gain alone were important, the parallel conductors would be made shorter and the spacing between them would be greater. If a wide bandwidth were important, the parallel conductors would be longer and the spacing between them would be smaller.

The generator symbol, 312, represents the effective feeding point or the point at which the associated electronic equipment is connected to the antenna element. Hereinafter in this description and the attached claims the term associated electronic equipment will refer to the kinds of equipment that could be connected to antennas, such as transmitters, receivers, security equipment, etc.

CONSTRUCTION TACTICS

Turning to construction matters, the desirable cross-sectional size of antenna conductors depends, of course, upon mechanical as well as electrical considerations. For example, the large antenna elements needed in the high-frequency spectrum probably would have conductors formed by several sizes of tubing. This is because the parts at the end of the antenna element support only themselves while the parts near the center must support themselves and the parts further out in the antenna element. This variety of mechanical strengths required would make convenient a variety of conductors. This is somewhat illustrated by FIG. 4, which has a quadruple-delta antenna element formed by parts 401 to 412 in front of a screen, 413. The outer parallel conductors, 405 and 410, have smaller diameters than the central parallel conductor, 402. The remaining diagonal conductors have diameters between the diameters of these parallel conductors. At ultra-high frequencies, on the other hand, it may be convenient to construct these antennas using a single size of tubing, because only a small cross-sectional area may be needed anywhere in such small antenna elements.

Although the triangular shape serves the purpose of allowing the parallel conductors to be separated farther than is possible with other shapes, it is not necessary that the shape be strictly triangular. The curved "hour glass" shape of FIG. 4, for example, could be convenient because this shape places the joining conductors at right angles to each other. If holes must be drilled or if clamps must be made, it is often convenient to have a 90-degree angle between the conductors. This aim of having the conductors meet at right angles also could be met by having the diagonal conductors straight except for the places near where the conductors meet. However, this tactic would forego another advantage of the continuously curved shape. Those curves seem to be more pleasing to some people than straight lines.

At or above the very-high frequencies, bending the small conductors probably would be the chosen method of using this idea. At lower frequencies, where the conductors would be large in diameter, dividing the conductors into small pieces with special couplings between the pieces to achieve such a shape may be a preferable method.

There are many conventional and acceptable means of connecting the various parts of quadruple-delta antenna elements. For example, they could be bolted, held by various kinds of clamps, or soldered, brazed or welded with or without pipe fittings at the joints. As long as the effect of the means of connection upon the effective length of the parts is taken into account, there seems to be no conventional means of connecting antenna parts that would not be acceptable for quadruple-delta antenna elements. However, before the final dimensions have been obtained, it is convenient to use clamps that allow adjustments to the length of the parallel conductors. Often a computer-aided design will produce reasonably correct distances between the parallel conductors and between the various quadruple-delta antenna elements in the array. Therefore, adjusting only the lengths of the parallel conductors on the antenna range will be an acceptable tactic to produce a final design.

Figure 4:
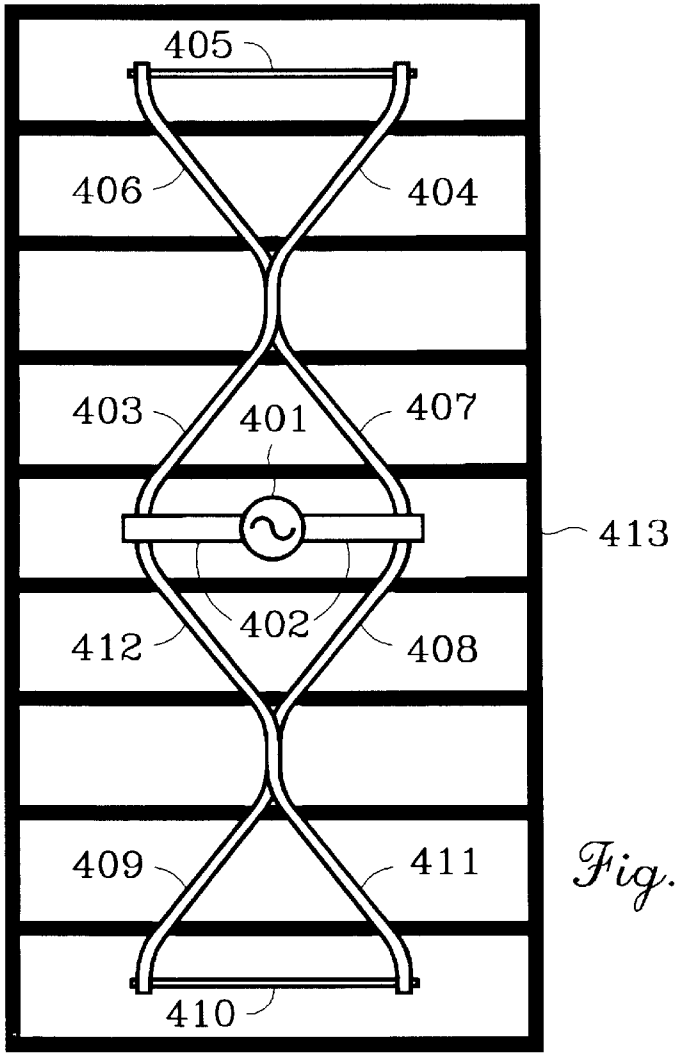
FIG. 4 illustrates the front view of a quadruple-delta antenna element in front of a reflecting screen that illustrates some useful construction tactics.

Since the diagonal conductors must not touch where they cross, it is apparent that the various parts will not be exactly coplanar. One possibility is that the diagonal conductors will be bent out of and back into the plane so that they are in front of or behind the plane where they cross to avoid contact, but they are coplanar at the outer parallel conductors. Another possibility is that the diagonal conductors will be bent only in one direction so that they will extend in front of or behind the plane at their outer ends. In such a case, each outer parallel conductor will be in front of the plane at one end and behind the plane at the other end. Within that latter possibility, there are two more possibilities. In FIG. 4, the diagonal conductors denoted as parts 406, 407, 408, and 409 are behind the plane and, therefore, the outer parallel conductors extend behind the plane at their left ends, in this diagram, and in front of the plane at their right ends. In FIG. 3, the diagonal conductors denoted as parts 305 and 306 extend behind the plane at their outer ends, but the parts 307 and 308 are in front of the plane at their outer ends. Therefore, in this last case, the two outer parallel conductors are neither exactly in the plane of the central parallel conductor nor in the same plane as each other.

If the diagonal conductors were not separated very far where they crossed, there would seem to be no particular electrical significance to these various possibilities of avoiding electrical contact where the diagonal conductors cross. Therefore, the method chosen can be whatever is most convenient from a mechanical point of view in the particular application. However, in arrays of quadruple-delta antenna elements, it probably would be wise to use the same method for all the antenna elements so that the spacing is equal between corresponding parts of the antenna elements.

Figure 5:
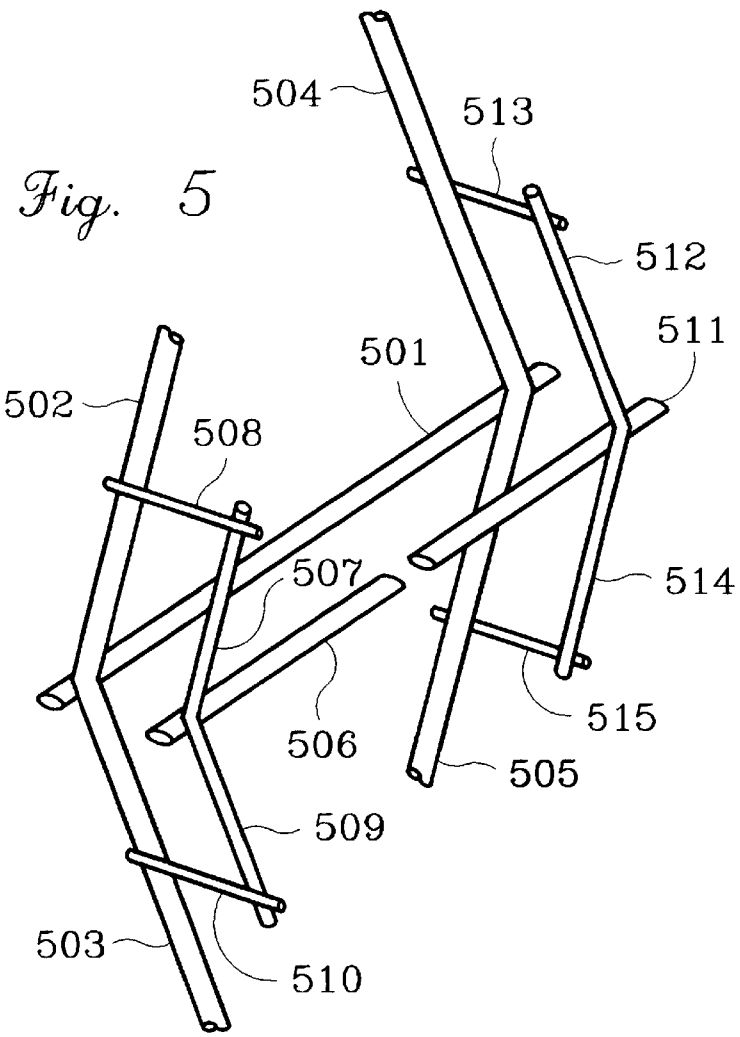
FIG. 5 illustrates a perspective view of a matching system appropriate for quadruple-delta antenna elements.

Since the impedance of a quadruple-delta antenna element is not likely to equal the characteristic impedance of the transmission line leading to the associated electronic equipment, some kind of matching system will be desirable in most cases. For matching a half-wave dipole, a T match tuned with capacitors in series with the T conductors is a conventional choice for connecting, in effect, to the center of the dipole. The quadruple-delta antenna element can use similar tactics, with a modification, as FIG. 5 shows. Usually the central parallel conductor (501) is too short to accommodate the length of T (506 and 511) that is needed for matching. One solution to that problem is extensions to the T's (507, 509, 512, and 514) along the diagonal conductors (502, 503, 504, and 505). The shorting bars (508, 510, 513, and 515) connect the extensions to the diagonal conductors. Hereinafter, such a system will be called a winged-T match. To maintain an equal power distribution around the central parallel conductor, the extensions preferably should be of equal length and the main part of the T should be either in front of or behind the central parallel conductor, in the orientation of FIG. 5. Putting the T above or below the central parallel conductor would upset the balance of fields and produce an unequal power distribution between the two halves of the antenna element.

Instead of the use of tuning capacitors in series with the T conductors, it is sometimes useful to use capacitors connected between the T's and the central point of the central parallel conductor. Sometimes, both these parallel capacitors and the more traditional series capacitors are used. Such tactics may make it possible to obtain a match without the extensions of the T's along the diagonal conductors but, of course, the adjustment procedure would be more complicated because there would be more things to adjust. A capacitor connected between the T's or an open-circuit transmission line stub connected in that place also may serve the purpose. That last tactic would have the advantage of reducing the number of parts requiring adjustment. To avoid unnecessary confusion in the diagram, these conventional tactics for tuning T matches are not shown in FIG. 5

THE DOUBLE-LOOP VERSION

For some applications, a variation of this basic quadruple-delta antenna element can be beneficial. When antenna parts are close to each other or when antennas are close to ground, in terms of wavelengths, the terminal impedances can be rather low. This could produce a problem of efficiency if the loss resistance of the parts became significant relative to the resistance that represents the antenna's radiation. To raise the impedance, one tactic with half-wave dipoles is to have an antenna element with more than one current path, such as the folded dipole. The antennas in Moore's patent also used multiturn loops.

Figure 6:
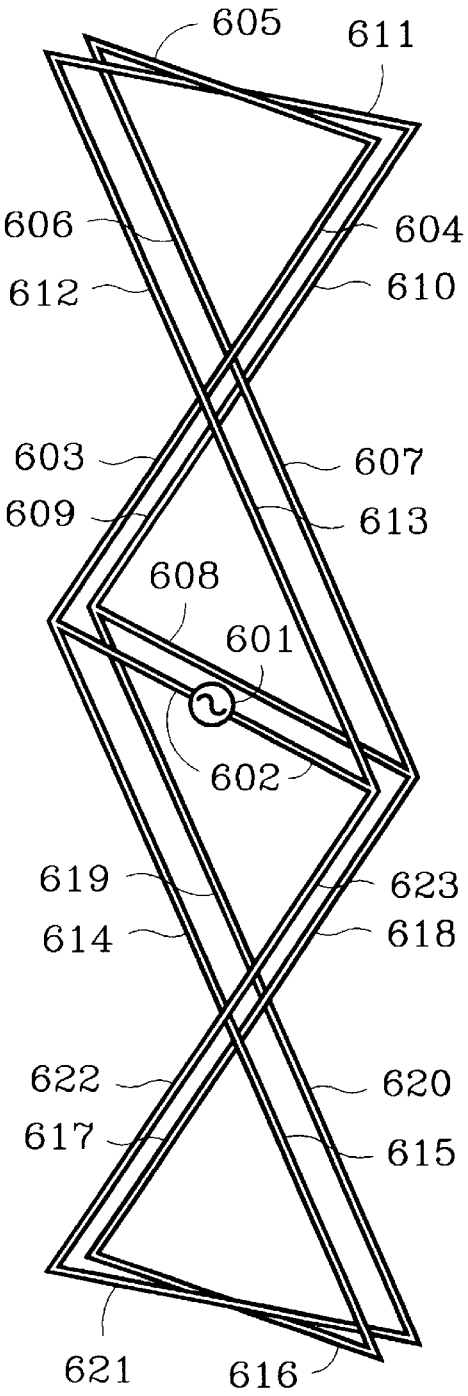
FIG. 6 illustrates the perspective view of a quadruple-delta antenna element formed with two-turn loops.

FIG. 6 shows the equivalent embodiment of quadruple-delta antenna elements. Hereinafter, it will be called a double-loop quadruple-delta antenna element. The tactic is to replace single current paths around the loops by paths that allow the currents to travel around the loops twice. In FIG. 6, one current path is from the generator symbol, 601, in the middle of part 602, through parts 603 to 613 to return to part 602. The other path is from part 602, through parts 614 to 618, part 608, and parts 619 to 623, to return to part 602. Depending on the dimensions, this tactic can significantly raise the terminal impedance. Of course, as it is with dipoles and single loops, more than two current paths around the loops could be used.

When the two quadruple-delta antenna elements are close to each other, there is a slight difference in the radiation in the two directions perpendicular to the planes of the conductors. If the spacing were larger, that difference would be larger. Usually, this difference would be minimized by using a close spacing, but sometimes the difference may be useful. If only one double-loop quadruple-delta antenna element could be used, perhaps because it were large, a wider spacing could be a convenient method to get a somewhat unidirectional radiation pattern.

APPLICATION—TURNSTILE ARRAYS

Figure 7:
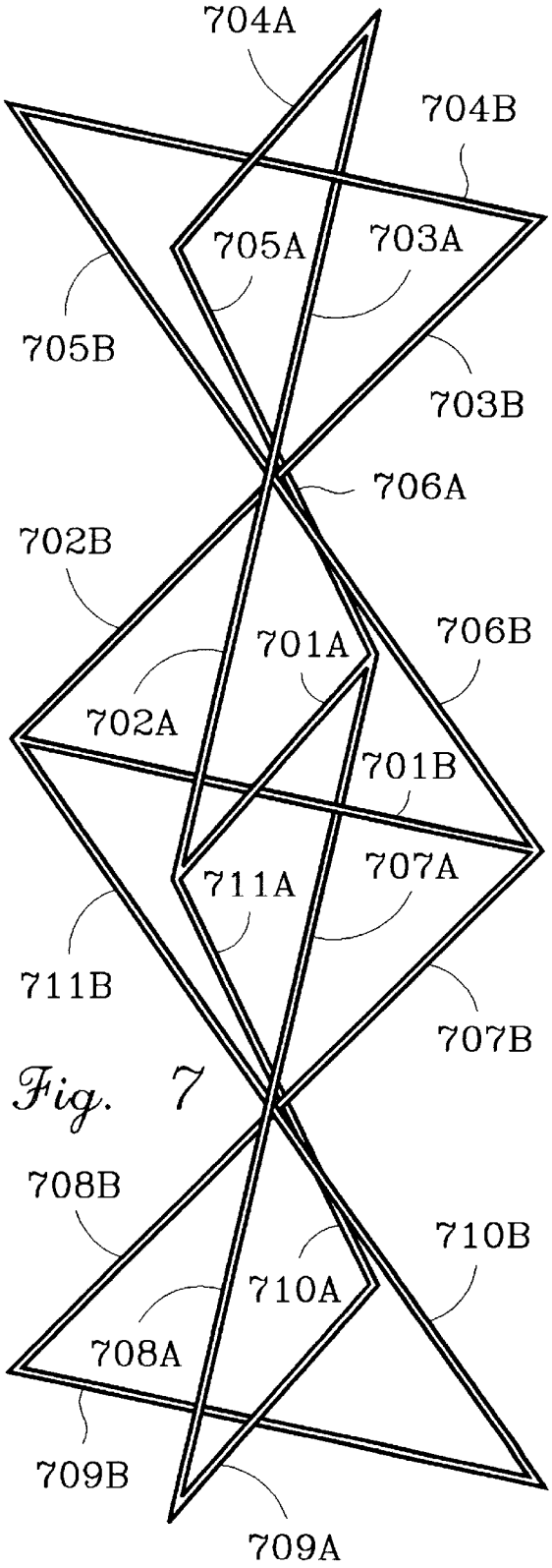
FIG. 7 illustrates a perspective view of a turnstile array of two quadruple-delta antenna elements.

These basic antenna elements usually can be used in the ways that half-wave dipoles are used. That is, combinations of them of particular sizes can be used to produce better antennas. For example, for broadcasting or for networks of stations, a horizontally-polarized radiation pattern is often needed that is omnidirectional instead of unidirectional in the horizontal plane. To achieve this, an old antenna called a turnstile array sometimes has been used. It has two half-wave dipoles oriented at right angles to each other and fed 90 degrees out of phase with each other. FIG. 7 shows the equivalent arrangement of quadruple-delta antenna elements, which would serve the same purpose. Hereinafter, this arrangement will be called a turnstile array of quadruple-delta antenna elements. Parts 701A to 711A form one quadruple-delta antenna element, and parts 701B to 711B form the other one. Conventional matching and phasing systems could be used, so they are not shown in FIG. 7 to avoid unnecessary confusion in the diagram.

In order to produce an omnidirectional radiation pattern, the currents in the corresponding conductors should be equal in amplitude and unequal in phase by 90 degrees. That is, for example, the current in the central parallel conductor 701A could be 90 degrees ahead of the current in the central parallel conductor 701B. In that case, the current in diagonal conductor 702A should be 90 degrees ahead of the current in diagonal conductor 702B. Hereinafter in this description and the attached claims, this kind of correspondence between conductors in similar antenna elements will be the meaning of the term "corresponding conductors".

Such an array would produce more gain in the principal H plane, which usually would be the vertical plane, than a similar array of dipoles or double-delta antenna elements. That is, if it were necessary to have several turnstile arrays stacked vertically for increased gain, the stack of turnstile arrays of quadruple-delta antenna elements would require fewer feed points for the same amount of gain.

If a quadruple-delta antenna element were connected to the associated electronic equipment in a balanced manner, the center of the central parallel conductor would be at ground potential. Also, since the two paths between the center of the central parallel conductor and the center of either outer parallel conductor have equal electrical lengths, the centers of the outer parallel conductors also would be at ground potential. Therefore, all three centers could be connected to a grounded supporting mast without changing the operation of the antenna element. Therefore, a turnstile array could have all the parallel-conductor centers connected to a supporting mast to produce a rugged antenna. However, because the centers of the diagonal conductors are not necessarily at ground potential, they should be insulated from any such grounded supporting mast. This could be done by bending the diagonal conductors enough to avoid contact with the mast and the other diagonal conductors.

This tactic of joining the parts that are at ground potential also could be used with quadruple-delta antenna elements that are not in turnstile arrays. If the antenna elements were rather large, this extra means of support could be very useful. However, note that the centers of the outer parallel conductors of double-loop quadruple-delta antenna elements are not at ground potential. Therefore, they should not be connected to the centers of their central parallel conductors. Only the centers of the two central parallel conductors are at ground potential in such antenna elements.

Of course, turnstile arrays could be made with three or more quadruple-delta antenna elements, spaced physically and electrically by less than 90 degrees. For example, three antenna elements could be spaced by 60 degrees. Such an array may produce a radiation pattern that is closer to being perfectly omnidirectional, but such an attempt at perfection would seldom be necessary. More useful might be two antenna elements spaced physically and electrically by angles that may or may not be 90 degrees, with equal or unequal energy applied. Such an array could produce a somewhat directive pattern, which might be useful if coverage were needed more in some directions than in other directions.

APPLICATION—COLLINEAR AND BROADSIDE ARRAYS

Another application of quadruple-delta antenna elements arises from observing that half-wave dipoles traditionally have been positioned in the same plane either end-to-end (collinear array), side-by-side (broadside array), or in a combination of those two arrangements. Often, a second set of such dipoles, called reflectors or directors, is put into a plane parallel to the first one, with the dimensions chosen to produce a somewhat unidirectional pattern of radiation. Sometimes an antenna element is placed in front of a reflecting screen (413), as in FIG. 4. Hereinafter in this description and the attached claims, the front of an antenna will be the end pointing in the direction of the desired radiation. The rear of an antenna will be the opposite end from the front end. Such arrays have been used on the high-frequency bands by short-wave broadcast stations, on very-high-frequency bands for television broadcast reception, and by radio amateurs.

Figure 8:
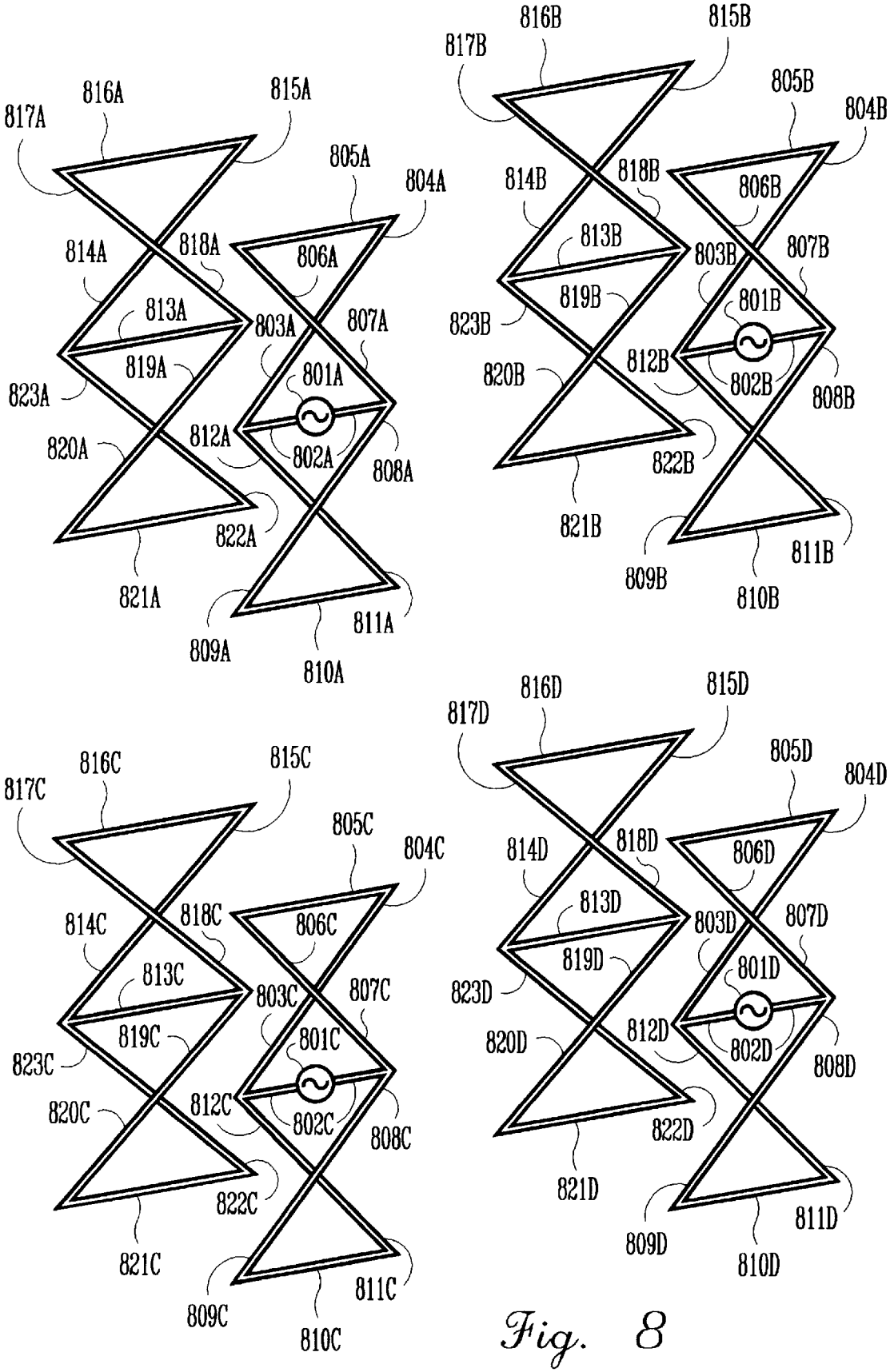
FIG. 8 illustrates a perspective view of four arrays of quadruple-delta antenna elements with similar reflecting antenna elements to illustrate the collinear and broadside arrangements of such antenna elements.

The same tactics can be used with quadruple-delta antenna elements, as FIG. 8 shows. The array having parts 801A to 823A is in a collinear arrangement with the array having parts 801B to 823B, because their corresponding parallel conductors are aligned in the direction parallel to the parallel conductors. That is, they are positioned end-to-end.

The array having parts 801C to 823C and the array having parts 801D to 823D are similarly positioned. The A array is in a broadside arrangement with the C array, because their corresponding parallel conductors are aligned in the direction perpendicular to the parallel conductors. The B array and the D array are similarly positioned.

Perhaps the main advantage of using quadruple-delta antenna elements rather than dipoles in such arrays is the less complicated system of feeding the array for a particular overall array size. That is, each quadruple-delta antenna element would perform in such an array as well as two or more half-wave dipoles.

Sometimes collinear or broadside arrays of dipoles have used unequal distributions of energy between the dipoles to reduce the radiation in undesired directions. Since quadruple-delta antenna elements reduce such undesired radiation anyway, there would be less need to use unequal energy distributions in equivalent arrays to achieve the same kind of result. Nevertheless, if such unequal energy distributions were used, it should be less complicated to implement because of the less complicated feeding system.

APPLICATION—NONLINEAR POLARIZATION

Yet another application of quadruple-delta antenna elements concerns nonlinear polarization. For communications with satellites or for communications on earth through the ionosphere, the polarization of the signal may be elliptical. In such cases, it may be advantageous to have both vertically polarized and horizontally polarized antennas. They may be connected together to produce a circularly polarized antenna, or they may be connected separately to the associated electronic equipment for a polarity diversity system. Also, they may be positioned at approximately the same place or they may be separated to produce both polarity diversity and space diversity.

Figure 9:
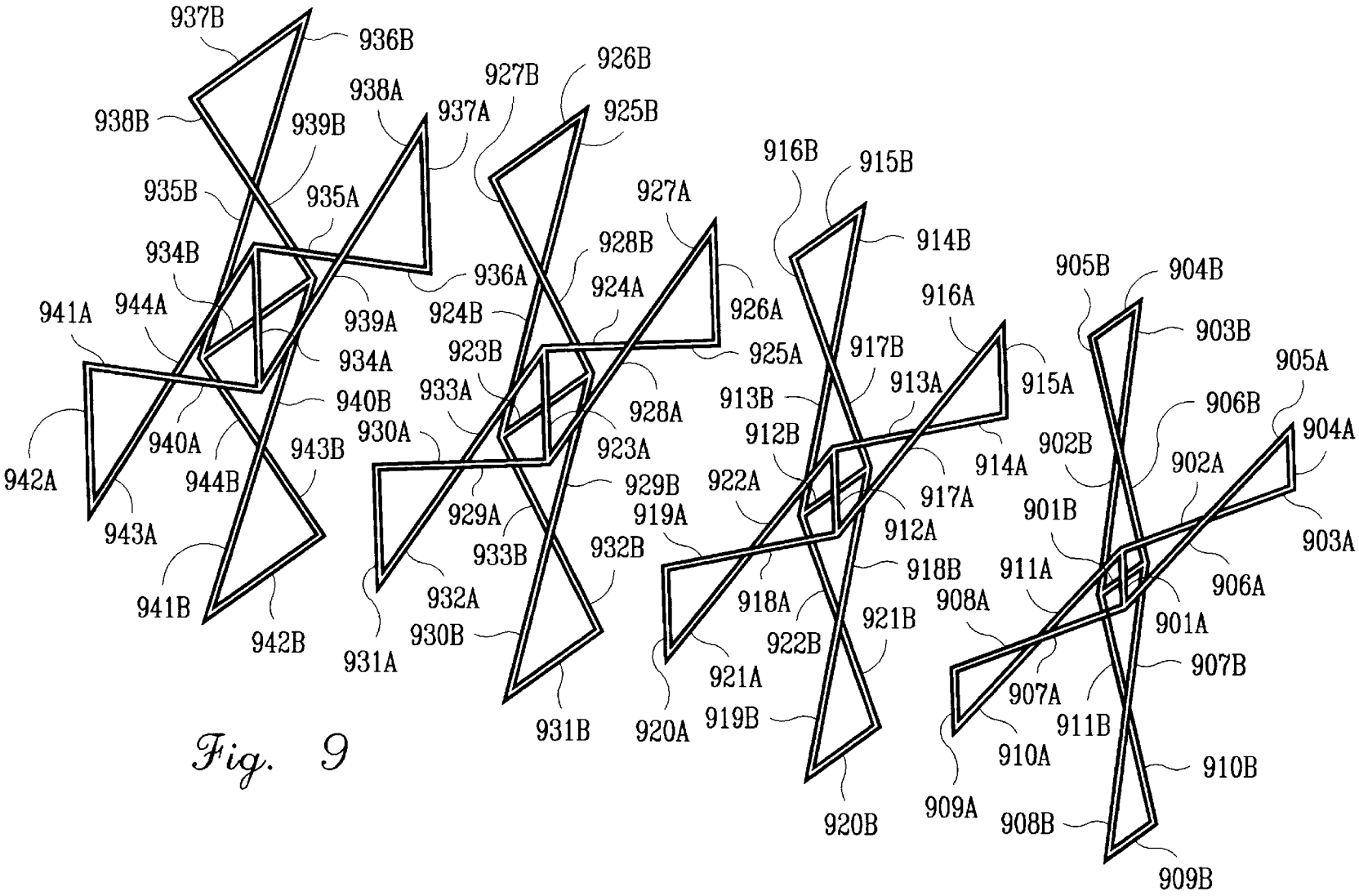
FIG. 9 illustrates a perspective view of the combination of two end-fire arrays of quadruple-delta antenna elements disposed and connected to produce circularly polarized radiation.

FIG. 9 illustrates an array of quadruple-delta antenna elements for achieving this kind of performance. Parts 901A to 944A form a vertically polarized array and parts 901B to 944B form a horizontally polarized array. If the corresponding quadruple-delta antenna elements of the two arrays were approximately at the same positions along the supporting boom, as in FIG. 9, the phase relationship between equivalent parts in the two arrays usually would be about 90 degrees for approximately circular polarization. If the corresponding quadruple-deltas antenna elements of the two arrays were not in the same position on the boom, as is common with similar half-wave dipole arrays, some other phase relationship could be used because the difference in position plus the difference in phase could produce the 90 degrees for circular polarization. It is common with equivalent half-wave dipole arrays to choose the positions on the boom such that the two arrays can be fed in phase and still achieve circular polarization.

However, one should not assume that this choice of position on the boom and phasing does not make a difference in the radiation produced. If two half-wave dipoles were positioned at the same place and were phased 90 degrees, there would tend to be a maximum of one polarity toward the front and a maximum of the other polarity toward the rear. For example, there could be a maximum of right-hand circularly polarized radiation to the front and a maximum of left-hand circularly polarized radiation to the rear. In the same example, there would be a null, ideally, of left-hand radiation to the front and a null of right-hand radiation to the rear. An equivalent array that produces the phase difference entirely by having the two dipoles in different positions on the boom would perform differently. Depending on how it was connected, it could have maxima of left-hand radiation to the front and rear. In such a case, the right-hand radiation would have maxima to the side and minima to the front and rear.

Of course, such arrays of individual dipoles would perform differently from such arrays of quadruple-delta antenna elements. Also, if these antenna elements were put into larger arrays, the patterns would change some more. Nevertheless, one should not assume that the choice of using phasing or positions on the boom to achieve circular polarization does not change the antenna performance. One must make the choice considering what kind of performance is desired for the particular application.

Although this arrangement of antenna elements usually is chosen to produce circularly polarized radiation, one also should note that a phase difference of zero degrees or 180 degrees will produce linear polarization. As the array is shown in FIG. 9, those linear polarizations would be at a 45-degree angle to the earth, which probably would not be desired. It probably would be more desirable to rotate the array around the direction of the axes of the triangles by 45 degrees to produce vertical or horizontal polarization. With such an array, it would be possible to choose vertical polarization, horizontal polarization, or either of the two circular polarizations by switching the amount of phase difference applied to the system. Such a system may be very useful to radio amateurs who use vertical polarization for frequency modulation, horizontal polarization for single sideband and Morse code, and circular polarization for satellite communication on very-high-frequency and ultra-high-frequency bands. It also could be useful on the high-frequency bands because received signals can have various polarities.

APPLICATION—YAGI-UDA ARRAYS

Figure 10:
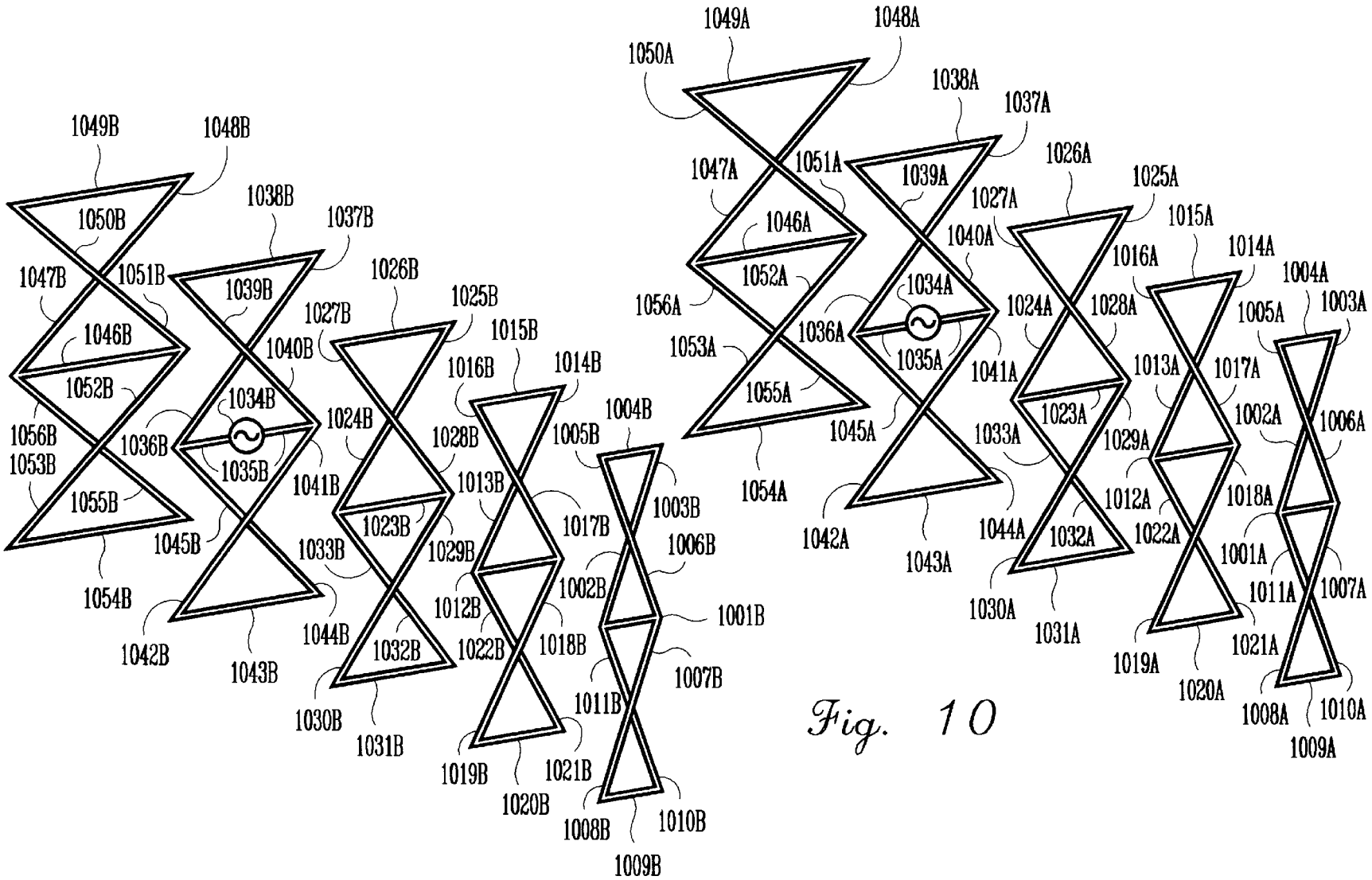
FIG. 10 illustrates a perspective view of two Yagi-Uda arrays of quadruple-delta antenna elements pointing in the same direction.

Yet another application, commonly called an end-fire array, has several quadruple-delta antenna elements positioned so that they are in parallel planes and the parallel conductors in each antenna element are parallel to the parallel conductors in the other antenna elements. One quadruple-delta antenna element, some of them, or all of them could be connected to the transmitter or receiver. If the second quadruple-delta antenna element, counting from the rear, were so connected, as in FIG. 10, and the dimensions produced the best performance toward the front, it could logically be called a Yagi-Uda array of quadruple-delta antenna elements. Hereinafter, that name will be used for such arrays. FIG. 10 illustrates two such Yagi-Uda arrays in a collinear arrangement: parts 1001A to 1056A forming one of them and parts 1001B to 1056B forming the other one. Hereinafter, the quadruple-delta antenna elements having the generator symbols, 1034A and 1034B, will be called the driven elements. The elements to the rear with parts 1046A to 1056A and parts 1046B to 1056B will be called the reflector elements. The remaining elements will be called the director elements. This terminology is conventional with the traditional names for dipoles in Yagi-Uda arrays. Another less popular possible array would be to have just two such antenna elements with the rear one connected, called the driven element, and the front one not connected, called the director element.

The tactic for designing a Yagi-Uda array is to employ empirical methods rather than equations. This is partly because there are many combinations of dimensions that would be satisfactory for a particular application.

Fortunately, there are computer programs available that can refine designs if reasonable trial designs are presented to the programs. That is as true of quadruple-delta arrays as it is for dipole arrays. To provide a trial design, it is common to make the driven element resonant near the operating frequency, the reflector element resonant at a lower frequency, and the director elements resonant at progressively higher frequencies from the rear to the front. Then the computer program can find the best dimensions near to the trial dimensions.

The use of quadruple-delta antenna elements in such an array differs in two respects. Since the radiation pattern in the principal H plane can be changed, that is something to choose. A pattern like that of FIG. 1B may be chosen to suppress the radiation in undesired directions. The second factor is that in arrays that have quadruple-delta antenna elements aligned from the front to the rear, one should remember that the principal radiating parts, the parallel conductors, should preferably be aligned to point in the direction of the desired radiation, perpendicular to the planes of the individual antenna elements. That is somewhat important in order to achieve the maximum gain, but it is more important in order to suppress the radiation in undesired directions. Therefore, when the resonant frequencies of the antenna elements must be unequal, the lengths of the parallel conductors should be chosen so that the distances between the parallel conductors are equal. That is, the distances between the parallel conductors should preferably be chosen to get the desired pattern in the principal H plane, and the lengths of the parallel conductors should be changed to achieve the other goals, such as the desired gain.

APPLICATION—ALL-DRIVEN ARRAYS

Figure 11:
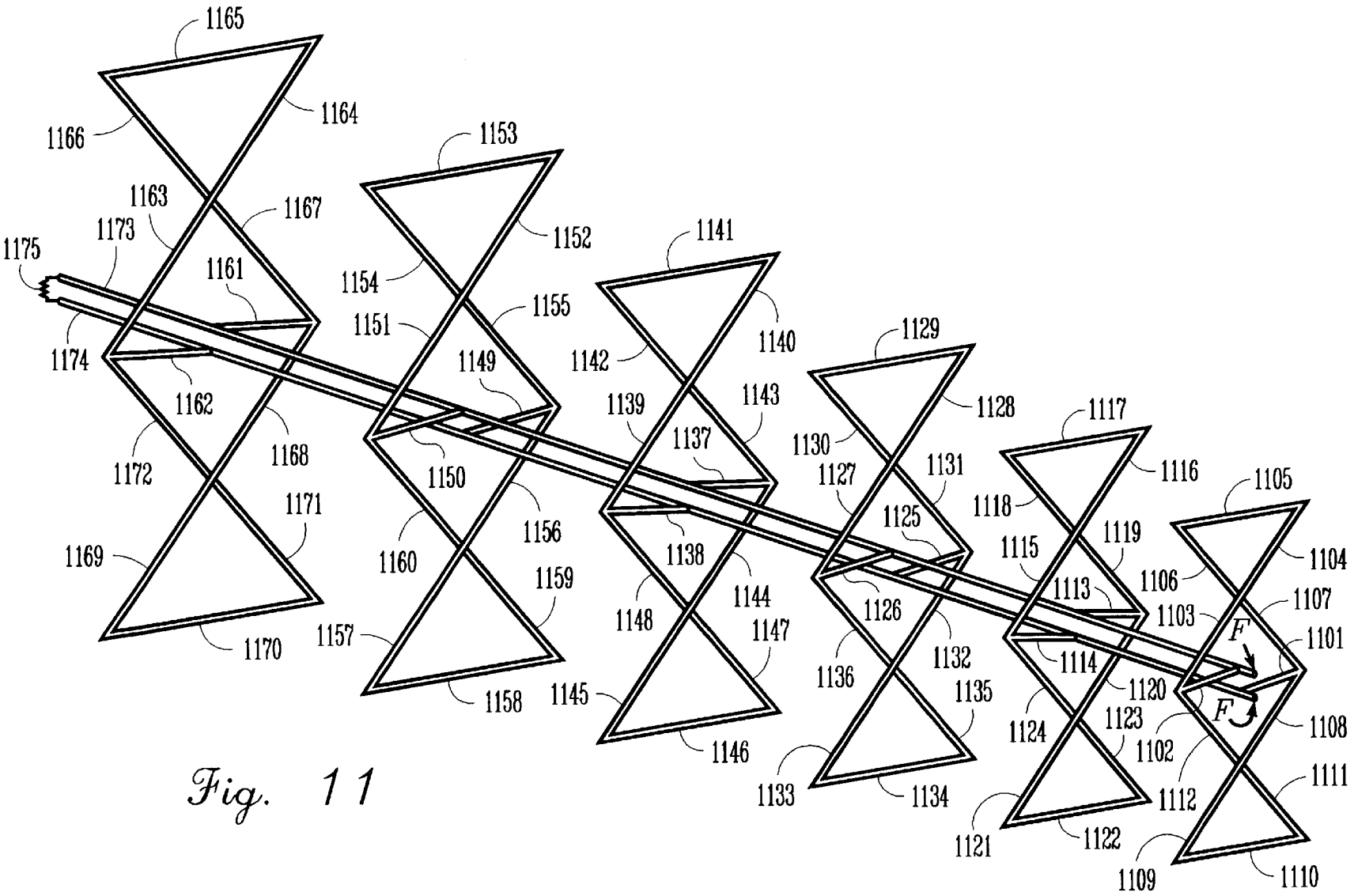
FIG. 11 illustrates a log-periodic array of quadruple-delta antenna elements.

There are several possibilities for all-driven end-fire arrays but, in general, the mutual impedances make such designs rather challenging and the bandwidths can be very small. The log-periodic array, as illustrated by FIG. 11, is a notable exception. A smaller, feasible all-driven array would be just two identical quadruple-delta antenna elements that are fed 180 degrees out of phase with each other. The space between the antenna elements would not be critical, but one-eighth of a wavelength would be a reasonable value. This would be similar to the dipole array disclosed by John D. Kraus in *Radio* of March, 1937, which is commonly called a W8JK array, after his amateur-radio call letters. Since the impedances of the two antenna elements are equal when the phase difference is 180 degrees, it is relatively easy to achieve an acceptable bidirectional antenna by applying such tactics. If a balanced transmission line were used, the conductors going to one antenna element would be simply transposed. For coaxial cable, an extra electrical half wavelength of cable going to one antenna element might be a better device to provide the desired phase reversal. If the space were available, such a bidirectional array of quadruple-delta antenna elements could be very desirable in the lower part of the high-frequency spectrum where rotating antennas may not be practicable because they are very large.

Another possibility is two antenna elements spaced and connected so that the radiation in one direction almost is canceled. An apparent possibility is a distance between the antenna elements of a quarter wavelength and a 90-degree phase difference in their connection. Other space differences and phase differences to achieve unidirectional radiation will produce more or less gain, as they will with half-wave dipoles.

LOG-PERIODIC ARRAYS

The log-periodic array of quadruple-delta antenna elements is similar in principle to the log-periodic dipole antenna disclosed by Isbell in his U.S. Pat. No. 3,210,767. Hereinafter, that combination will be called a quadruple-delta log-periodic antenna. Log-periodic arrays of half-wave dipoles are used in wide-band applications for military and amateur radio purposes, and for the reception of television broadcasting. The merit of such arrays is a relatively constant impedance at the terminals and a reasonable radiation pattern across the design frequency range. However, this is obtained at the expense of gain. That is, their gain is poor compared to narrow band arrays of similar lengths. Although one would expect that gain must be traded for bandwidth in any antenna, it nevertheless is disappointing to learn of the low gain of such relatively large arrays.

If one examined the radiation pattern of a typical log-periodic dipole array in the principal E plane, it would appear to be a reasonable pattern of an antenna of reasonable gain, because the major lobe of radiation is reasonably narrow. However, the principal H plane would show a considerably wide major lobe that indicates poor gain. This poor performance in the principal H plane is, of course, caused by the use of half-wave dipoles. Because half-wave dipoles have circular radiation patterns in the principal H plane, they do not help the array to produce a narrow major lobe of radiation in that plane.

The quadruple-delta antenna elements are well suited to improve the log-periodic array because they can be designed to suppress the radiation 90 degrees away from the center of the major lobe, as in FIG. 1B. That is, for a horizontally polarized log-periodic array, as in FIG. 11, the radiation upward and downward is suppressed. However, since the overall array of parts 1101 to 1172 produces quadruple-delta antenna elements of various sizes, several of which are used at any particular frequency, it is overly optimistic to expect that the radiation from the array in those directions will be suppressed as well as it can be from a single quadruple-delta antenna element operating at one particular frequency. Nevertheless, the reduction of radiation in those directions and, consequently, the improvement in the gain can be very significant.

As stated above, arrays that have quadruple-delta antenna elements aligned from the front to the rear, should preferably have their parallel conductors aligned to point in the direction of the desired radiation, perpendicular to the planes of the individual antenna elements. That is, the distances between the parallel conductors should be equal. Hereinafter, thinking of a horizontally polarized array as in FIG. 11, the distance between the outer parallel conductors will be called the height. The length of the longest parallel conductor will be called the width. That equal-height alignment usually is not a problem with Yagi-Uda arrays. This is partly because only one of the quadruple-delta antenna elements in the array is connected to the associated electronic equipment, and partly because the range of frequencies to be covered usually is small enough that there is not a great difference in the sizes of the various quadruple-delta antenna elements in the array. Therefore, it is preferable and convenient to align the parallel conductors.

One problem with equal-height alignments of quadruple-delta log-periodic arrays occurs because the purpose of log-periodic arrays is to cover a relatively large range of frequencies. Therefore, the range of dimensions is relatively large. It is not unusual for the resonant frequency of the largest antenna element in a log-periodic array to be one-half of the resonant frequency of the smallest antenna element. One result of this is that if one tried to achieve that range of resonant frequencies with a constant height, it is common that the appropriate height of the largest quadruple-delta antenna element in the array for a desirable radiation pattern at the lower frequencies would be larger than the perimeter of the loops of the smallest antenna element. Hence, such an equal-height array would be practicable only if the range of frequencies covered were not very large.

Another problem occurs because all of the individual quadruple-delta antenna elements are connected in a log-periodic array. Therefore, the relationship between the impedances of the antenna elements is important. The problem of equal-height log-periodic designs is that the impedances of high and narrow quadruple-delta antenna elements are quite different from the impedances of short and wide versions. The design of the connecting system, which depends on those impedances, might be unduly complicated if these unequal impedances were taken into account. In addition, the design might be complicated by the fact that the radiation pattern would change if the ratio of the height to width were changed. Therefore, instead of using equal heights, it may be preferable to accept the poorer gain and poorer suppression of radiation to the rear resulting from the nonaligned parallel conductors in order to use quadruple-delta antenna elements that are proportional to each other in height and width.

Sometimes, a compromise between the extremes of equal height and proportional dimensions is useful. For example, the resonant frequencies of adjacent quadruple-delta antenna elements may conform to a constant ratio, the conventional scale factor, but the heights may conform to some other ratio, such as the square root of the scale factor.

APPLICATION—LOG-PERIODIC DESIGN TACTICS

Whether equal-height quadruple-delta antenna elements or proportional dimensions are used, the design principles are similar to the traditional principles of log-periodic dipole arrays. However, the details would be different in some ways. The scale factor ($\tau$) and spacing factor ($\sigma$) usually are defined in terms of the dipole lengths, but there would be no such lengths available if the individual antenna elements were not half-wave dipoles. It is better to interpret the scale factor as the ratio of the resonant wavelengths of adjacent quadruple-delta antenna elements. If the design were proportional, that also would be the ratio of any corresponding dimensions in the adjacent antenna elements. For example, for the proportional array of FIG. 11, the scale factor would be the ratio of any dimension of the second largest antenna element formed by parts 1149 to 1160 divided by the corresponding dimension of the largest antenna element formed by parts 1161 to 1172. The spacing factor could be interpreted as the ratio of the individual space to the resonant wavelength of the larger of the two quadruple-delta antenna elements adjacent to that space. For example, the spacing factor would be the ratio of the space between the two largest quadruple-delta antenna elements to the resonant wavelength of the largest antenna element.

Some other standard factors may need more than reinterpretation. For example, since the impedances of quadruple-delta antenna elements do not equal the impedances of dipoles, the usual impedance calculations for log-periodic dipole antennas are not very useful. Also, since the antenna uses some quadruple-delta antenna elements that are larger and some that are smaller than resonant antenna elements at any particular operating frequency, the design must be extended to frequencies beyond the operating frequencies. For log-periodic dipole antennas, this is done by calculating a bandwidth of the active region, but there is no such calculation available for the quadruple-delta log-periodic antenna. Since the criteria used for determining this bandwidth of the active region were quite arbitrary, this bandwidth may not have satisfied all uses of log-periodic dipole antennas anyway.

However, if the array had a constant scale factor and a constant spacing factor, the antenna elements were connected with a transmission line with a velocity of propagation near the speed of light, like open wire, and the connections were reversed between each pair of antenna elements, the result would be some kind of log-periodic array. In FIG. 11, that transmission line is formed by the two conductors 1173 and 1174. Hereinafter in this description and the attached claims, these conductors will be called the feeder conductors, as is fairly common practice. The connection reversal is achieved by alternately connecting the left and right sides of the quadruple-delta antenna elements to the top and bottom feeder conductors. For example, the left side of the central parallel conductor of the largest antenna element, 1162, is connected to the bottom feeder conductor, 1174, but the left side of the central parallel conductor of the second largest antenna element, 1150, is connected to the top feeder conductor, 1173. The frequency range, the impedance, and the gain of such an array may not be what the particular application requires, but it will nevertheless be a log-periodic array. The task is just to start with a reasonable trial design and to make adjustments to achieve an acceptable design.

This approach is practicable because computer programs allow us to test antennas before they exist. No longer is it necessary to be able to calculate the dimensions with reasonable accuracy before an antenna must be made in the real world. The calculations can now be put into a computer spreadsheet, so the mechanical results of changes can be seen almost instantly. If the mechanical results of the calculations seemed promising, an antenna simulating program could show whether the design were electrically acceptable to a reasonable degree of accuracy.

To get a trial log-periodic design, the procedure could be as follows. What would be known is the band of frequencies to be covered, the desired gain, the desired suppression of radiation to the rear, the desired length of the array, and the number of quadruple-delta antenna elements that could be tolerated because of the weight and cost. The first factors to be chosen would be the scale factor ($\tau$) and the spacing factor ($\sigma$). The scale factor should be rather high to obtain proper operation, but it is a matter of opinion how high it should be. Perhaps a value of 0.88 would be a reasonable minimum value. A higher value would produce more gain. The spacing factor has an optimum value for good standing wave ratios across the band, good suppression of the radiation to the rear, and a minimum number of quadruple-delta antenna elements for a particular gain. Perhaps it is a good value to use to start the process.

$$\sigma_{opt}=0.2435\tau-0.052$$

Since the resonant frequencies of the largest and smallest quadruple-delta antenna elements cannot be calculated yet, it is necessary just to choose a pair of frequencies that are reasonably beyond the actual operating frequencies. These chosen frequencies allow the calculation of the number (N) of quadruple-delta antenna elements needed for the trial value of scale factor ($\tau$).

$$N=1+\log(f_{min}/f_{max})/\log(\tau)$$

Note that this value of N probably will not be an integer, which it obviously must be. The values chosen above must be changed to avoid fractional numbers of quadruple-delta antenna elements.

The calculation of the length of the array requires the calculation of the wavelength of the largest quadruple-delta antenna element. This can, of course, be done in any units.

$$\lambda_{max}=9.84\times10^8/f_{min}\ ft$$

$$\lambda_{max}=3\times10^8/f_{min}\ m$$

The length will be in the same units as the maximum wavelength.

$$L=\lambda_{max}\sigma(1-f_{min}/f_{max})/(1-\tau)$$

Therefore, the input to the calculations could be $f_{min}$, $f_{max}$, $\tau$ and $\sigma$, and the desired results could be N and L. Using the optimum value of the spacing factor, the calculation usually would produce a design that was longer than was tolerable. On the other hand, if a longer length could be tolerated, the scale factor could be increased to obtain more gain. To reduce the length, the prudent action usually is to reduce the spacing factor, not the scale factor, because that choice usually will maintain a reasonable frequency-independent performance.

Once a tolerable design is revealed by these calculations, they should be tested by an antenna simulating program. The largest quadruple-delta antenna element would be designed using the lowest design frequency ($f_{min}$) Perhaps it would be designed to produce the radiation pattern of FIG. 1B in order to produce a desirable pattern in the principal H plane. The dimensions of the remaining antenna elements would be obtained by successively multiplying the dimensions by the scale factor. The spaces between the antenna elements would be obtained by multiplying the wavelength of the larger adjacent antenna element by the spacing factor. An additional factor needed for the program would be the distance between the feeder conductors. For good operation, this distance should produce a relatively high characteristic impedance. Unless the scale factor were rather high, perhaps a minimum characteristic impedance of 200 ohms would be prudent.

The gain, front-to-back ratio, and standing wave ratio of this first trial probably would indicate that the upper and lower frequencies were not acceptable. At least, the spacing between the feeder conductors probably should be modified to produce the best impedance across the band of operating frequencies. Then new values would be entered into the calculations to get a second trial design.

What is an acceptable performance is, of course, a matter of individual requirements and individual standards. For that reason, variations from the original recommended practice are common. First, the optimum value of the spacing factor usually is not used in log-periodic dipole antennas because it would make the antennas too long.

Secondly, although the extension of the feeder conductors behind the largest quadruple-delta antenna element was recommended in early literature, it is seldom used. The original recommendation was that it should be about an eighth of a wavelength long at the lowest frequency and terminated in the characteristic impedance of the feeder conductors, which is represented by the resistance symbol 1175. It was more common practice to make the termination a short circuit. If the antenna were designed for proper operation, the current in the termination would be very small anyway, so the termination would do very little and usually could be eliminated. Actually, extending or not extending the feeder conductors may not be the significant choice. There may be a limit to the length of the feeder conductors. In that case, the choice may be whether it is better to raise the spacing factor to use the whole available length to support the quadruple-delta antenna elements or to spend a part of that available length for an extension.

Thirdly, the feeder conductors between the dipoles usually form an open-wire line transposed between each pair of dipoles, as in the patent of Isbell. That is, the feeder conductors often do not have a constant spacing and, therefore, a constant impedance. Nevertheless, designs acceptable to many people are produced with these variations. Therefore, in view of this inexact common practice and with the superior performance in the principal H plane that is available, it is not very difficult to produce better log-periodic antennas using quadruple-delta antenna elements.

The log-periodic array of FIG. 11 illustrates the appropriate connecting points, F, to serve a balanced transmission line leading to the associated electronic equipment. Other tactics for feeding unbalanced loads and higher-impedance balanced loads also are used with log-periodic dipole antennas. Because these tactics depend only on some kind of log-periodic array connected to two parallel tubes, these conventional tactics are as valid for such an array of quadruple-delta antenna elements as they are for such arrays of half-wave dipoles.

APPLICATION—LARGE ARRAYS

Both Yagi-Uda arrays and log-periodic arrays of quadruple-delta antennas can be used in the ways that such arrays of half-wave dipoles are used. For example, FIG. 9 shows two end-fire arrays that are oriented to produce elliptically polarized radiation. For another example, FIG. 10 shows two Yagi-Uda arrays oriented so that the corresponding quadruple-delta antenna elements of the two arrays are in the same vertical planes. In this case, there is a side-by-side or collinear orientation, because the parallel conductors of one array are positioned end-to-end with the equivalent parts of the other array. The arrays also could be oriented one above the other (broadside), or several arrays could be arranged in both orientations.

Since the gain of such large arrays tends to depend on the overall area of the antenna facing the direction of maximum radiation, it is unrealistic to expect much of a gain advantage from using quadruple-delta antenna elements in large arrays of a particular overall size. However, there are other advantages. Since the individual arrays in the overall array could have more gain if they were composed of quadruple-delta antenna elements, the feeding system could be simpler because fewer individual arrays would be needed to fill the overall space adequately. In addition, the superior ability of the quadruple-delta antenna elements to suppress received signals arriving from undesired directions is a considerable advantage when the desired signals are small. For communication by reflecting signals off the moon, the ability to suppress undesired signals and noise is a great advantage.

It is well known that there is some minimum spacing needed between the individual antenna elements in collinear or broadside arrays so that the gain of the whole antenna will be maximized. If the beam widths of the individual antenna elements were narrow, that minimum spacing would be larger than if the beam widths were wide. In other words, if the gains of the individual antenna elements were large, the spacing between them must be large. Large spacing, of course, increases the cost and weight of the supporting structure.

Because the half-wave dipole has no directivity in the principal H plane, Yagi-Uda arrays of half-wave dipoles usually have wider beam widths in the principal H plane than in the principal E plane. Therefore, the spacing necessary to obtain the maximum gain from two such arrays would be less for a broadside array than for a collinear array. That is, for a horizontally polarized array, it would be better from a cost and weight point of view to place the two arrays one above the other instead of beside each other. The quadruple-delta antenna element presents the opposite situation. Because the latter antenna element produces considerable directivity in the principal H plane, a Yagi-Uda array of them would have a narrower beam in the principal H plane than in the principal E plane. Therefore, it would be better to place two such arrays side-by-side, as in FIG. 10, rather than one above the other. Of course, mechanical or other considerations may make other choices preferable.

It also is unrealistic to expect that long Yagi-Uda arrays of quadruple delta antenna elements will have a large gain advantage over long Yagi-Uda arrays of half-wave dipoles. The principle of a minimum necessary spacing applies here as well. It is not exactly true, but one can consider that the double-delta and quadruple-delta antenna elements comprise dipoles, represented by the parallel conductors, joined by the diagonal conductors. Presented in that manner, a Yagi-Uda array of double-delta antenna elements could be considered equivalent to a broadside array two Yagi-Uda arrays of dipoles. Likewise, a Yagi-Uda array of quadruple-delta antenna elements could be regarded as three Yagi-Uda arrays of dipoles, because the quadruple-delta antenna element has three parallel conductors.

These three Yagi-Uda arrays each have some beam width in the principal H plane and, therefore, they should be separated by some minimum distance to produce the maximum gain for the combination. The longer the Yagi-Uda array is, of course, the narrower the individual H plane beams would be and the greater the spacing should be. That is, since the spacing is limited by the need to have approximately one-wavelength triangles, a long Yagi-Uda array of double-delta or quadruple-delta antenna elements would not have as much gain as one might expect. In particular, a long array of such antenna elements may not have much advantage at all over an array of half-wave dipoles of equal length.

That situation raises the question of how long Yagi-Uda arrays should be. One factor is that there usually is an advantage to making Yagi-Uda arrays of four double-delta antenna elements because four elements usually are required to produce an excellent suppression of the radiation to the rear of the array. Beyond that array length, the increase in gain for the increase in length probably will be disappointing, because the distance between the parallel conductors cannot be increased very much. That is, the usual expectation that doubling the length producing twice the gain will not be realized. It probably will be wiser to employ more than one Yagi-Uda array of double-delta antenna elements in a larger collinear or broadside array.

Because quadruple-delta antenna elements have more directivity in the principal H plane, a Yagi-Uda array of them can be longer before the advantage over a dipole array becomes too small. It depends on individual circumstances, but perhaps eight or ten quadruple-delta antenna elements in a Yagi-Uda array is a reasonable limit. Beyond that, it probably will be more profitable to use several Yagi-Uda arrays instead.

Conclusion

Except for the restrictions of size, weight, and cost, quadruple-delta antenna elements could be used for almost whatever purposes that antennas are used. Beside the obvious needs to communicate sound, pictures, data, etc., they also could be used for such purposes as radar or for detecting objects near them for security purposes. Since they are much larger than half-wave dipoles, it would be expected that they would generally be used at very-high and ultra-high frequencies. However, they may not be considered to be too large for short-wave broadcasting because that service typically uses very large antennas.

While this invention has been described in detail, it is not restricted to the exact embodiments shown. These embodiments serve to illustrate some of the possible applications of the invention rather than to define the limitations of the invention.

I claim:

1. An antenna element, comprising:

(a) three approximately parallel conductors, disposed in approximately the same plane, and separated from each other by approximately equal distances;

(b) four diagonal conductors, of approximately equal length, connect each of the ends of the proximal approximately parallel conductor to the opposite ends of the two distal approximately parallel conductors, without producing a connection where said diagonal conductors cross each other, thereby producing four approximately triangular conductors with perimeters of approximately one wavelength; and (c) means for connecting the associated electronic equipment to said antenna element effectively at the center of said proximal approximately parallel conductor.

2. The antenna element of claim 1 wherein the dimensions of said antenna element are chosen to maximize the performance of said antenna element in the direction perpendicular to said plane of said antenna element.

3. The antenna element of claim 1 wherein the dimensions of said antenna element are chosen to minimize the performance of said antenna element in the two directions in said plane of said antenna element that are perpendicular to said approximately parallel conductors of said antenna element.

4. The antenna element of claim 1 wherein the dimensions of said antenna element are chosen to produce a beneficial compromise between maximizing the performance of said antenna element in the direction perpendicular to said plane of said antenna element while minimizing said performance in other directions.

5. The antenna element of claim 1 wherein said three approximately parallel conductors are of approximately equal lengths.

6. The antenna element of claim 1 wherein said two distal approximately parallel conductors are of approximately equal lengths, and said proximal approximately parallel conductor is of a different length.

7. The antenna element of claim 1 wherein at least one of the conductors has a circular cross-sectional area.

8. The antenna element of claim 1 wherein at least one of the conductors has a solid cross-sectional area.

9. The antenna element of claim 1 wherein at least one of the conductors has a tubular cross-sectional area.

10. The antenna element of claim 1 wherein the conductors all have equal cross-sectional areas.

11. The antenna element of claim 1 wherein the conductors do not have equal cross-sectional areas.

12. The antenna element of claim 1 wherein all of the conductors are approximately straight.

13. The antenna element of claim 1 wherein at least one of the conductors is somewhat curved.

14. The antenna element of claim 1 wherein said approximately parallel conductors are disposed approximately parallel to the ground.

15. The antenna element of claim 1 wherein said approximately parallel conductors are disposed approximately perpendicular to the ground.

16. The antenna element of claim 1 wherein said approximately parallel conductors are disposed neither approximately parallel to the ground nor approximately perpendicular to the ground.

17. An antenna, comprising two interconnected antenna elements in two planes that are approximately parallel, such that:

(a) the perpendicular distance between said planes is much smaller than one wavelength;

(b) two proximal approximately parallel conductors, one in each of said planes, are disposed so that a line between their centers is approximately perpendicular to said planes;

(c) a first pair of diagonal conductors, of approximately equal length, extends from the ends of the first proximal approximately parallel conductor, in the plane of said first proximal approximately parallel conductor, so that these first diagonal conductors cross without touching at approximately their centers;

(d) a second pair of diagonal conductors, with lengths approximately equal to the lengths of said first pair of diagonal conductors, also extends from the ends of said first proximal approximately parallel conductor, in said plane of said first proximal approximately parallel conductor, but in the opposite direction from the direction of said first pair of diagonal conductors, so that these second diagonal conductors cross without touching at approximately their centers;

(e) a third pair of diagonal conductors, with lengths approximately equal to the lengths of the first two pairs of diagonal conductors, extends from the ends of the second proximal approximately parallel conductor, in the plane of said second proximal approximately parallel conductor and in the direction of said first pair of diagonal conductors, so that these third diagonal conductors cross without touching at approximately their centers;

(f) a fourth pair of diagonal conductors, with lengths approximately equal to the lengths of the first three pairs of diagonal conductors, also extends from the ends of said second proximal approximately parallel conductor, in said plane of said second proximal approximately parallel conductor, but in the direction of said second pair of diagonal conductors, so that these fourth diagonal conductors cross without touching at approximately their centers;

(g) a distal approximately parallel conductor, approximately parallel to said proximal approximately parallel conductors, connects from the distal end of one of said first diagonal conductors, on one side of said antenna, to the distal end of one of said third diagonal conductors, on the other side of said antenna;

(h) a second distal approximately parallel conductor, approximately parallel to said proximal approximately parallel conductors, connects from the distal end of the unconnected first diagonal conductor to the distal end of the unconnected third diagonal conductor;

(i) a third distal approximately parallel conductor, approximately parallel to said proximal approximately parallel conductors, connects from the distal end of one of said second diagonal conductors, on one side of said antenna, to the distal end of one of said fourth diagonal conductors, on the other side of said antenna;

(j) a fourth distal approximately parallel conductor, approximately parallel to said proximal approximately parallel conductors, connects from the distal end of the unconnected second diagonal conductor to the distal end of the unconnected fourth diagonal conductor;

(k) said distal approximately parallel conductors cross each other but do not touch each other;

(l) the lengths of the approximately parallel conductors and the diagonal conductors are such that each of the eight interconnected triangular conductors so produced have perimeters of approximately one wavelength; and (m) said antenna is connected to the associated electronic equipment only, effectively, at the center of one of said two proximal approximately parallel conductors.

18. An antenna system of at least one antenna, each of those antennas comprising two antenna elements, such that:

(a) in each of said antenna elements, there are three approximately parallel conductors, disposed in approximately the same plane, and separated from each other by approximately equal distances;

(b) in each of said antenna elements, four diagonal conductors, of approximately equal length, connect each of the ends of the proximal approximately parallel conductor, to the opposite ends of the two distal approximately parallel conductors, without producing a connection where said diagonal conductors cross each other, thereby producing four approximately triangular conductors with perimeters of approximately one wavelength;

(c) the planes of said two antenna elements are approximately perpendicular to each other;

(d) the intersection of said planes forms a line that passes much closer to the centers of all said approximately parallel conductors than the length of a wavelength and much closer to the crossing points of all said diagonal conductors than the length of a wavelength;

(e) except perhaps at said centers of said approximately parallel conductors, said two antenna elements do not touch each other;

(f) means are provided for connecting to the associated electronic equipment effectively at the centers of the proximal approximately parallel conductors so that the currents in the corresponding conductors of said two antenna elements are consistently related in amplitude by approximately equal ratios of values and are consistently unequal in phase by approximately equal amounts; and (g) said antennas are aligned so that the line of intersection of said planes of each of said antennas approximately is the line of intersection of said planes of the other antennas.

19. The antenna system of claim 18 wherein the amplitudes of the currents in said corresponding conductors of said two antenna elements of each of said antennas are approximately equal and the phases of said currents are consistently unequal by approximately 90 degrees.

20. The antenna system of claim 18 wherein there is only one antenna.

21. The antenna system of claim 18 wherein the relative amplitudes and phases of the currents in the corresponding conductors of said antennas and the distances between said antennas are such that the performance of said antenna system is maximized in the principal E plane.

22. The antenna system of claim 18 wherein the relative amplitudes and phases of the currents in the corresponding conductors of said antennas and the distances between said antennas are such that the performance of said antenna system is minimized in directions other than in the principal E plane.

23. The antenna system of claim 18 wherein the relative amplitudes and phases of the currents in the corresponding conductors of said antennas and the distances between said antennas are such that the performance of said antenna system is a beneficial compromise between maximizing said performance in the principal E plane and minimizing said performance in other directions.

24. An antenna system of at least one antenna, each of those antennas comprising at least one antenna element, such that:

(a) in each of those antenna elements, there are three approximately parallel conductors, disposed in approximately the same plane, and separated from each other by approximately equal distances;

(b) in each of said antenna elements, four diagonal conductors, of approximately equal length, connect each of the ends of the proximal approximately parallel conductor, to the opposite ends of the two distal approximately parallel conductors, without producing a connection where said diagonal conductors cross each other, thereby producing four approximately triangular conductors with perimeters of approximately one wavelength;

(c) said antenna elements, within each of said antennas, are disposed in planes approximately parallel to each other;

(d) said approximately parallel conductors, within each of said antennas, are all approximately parallel to each other;

(e) the centers of the proximal approximately parallel conductors, within each of said antennas, are aligned in the direction perpendicular to said planes of said antenna elements; and (f) means are provided to connect the associated electronic equipment effectively at the center of said proximal approximately parallel conductor of at least one of said antenna elements in each of said antennas.

25. The antenna system of claim 24, further including a reflecting screen disposed to the rear of said antenna system to produce a substantially unidirectional performance of said antenna system to the front of said antenna system in the direction perpendicular to said planes of said antenna elements.

26. The antenna system of claim 24 wherein there is only one antenna in said antenna system.

27. The antenna system of claim 24 wherein there is only one of said antenna elements in each of said antennas.

28. The antenna system of claim 24 wherein:

(a) there are just two of said antenna elements, with substantially equal dimensions, in each of said antennas;

(b) both of said antenna elements are connected to said associated electronic equipment; and (c) the manner of connection to said associated electronic equipment is such that the currents in the corresponding conductors of said two antenna elements are approximately equal in amplitude and approximately 180 degrees out of phase with each other.

29. The antenna system of claim 24 wherein:

(a) there are just two of said antenna elements, with substantially equal dimensions, in each of said antennas;

(b) both of said antenna elements are connected to said associated electronic equipment;

(c) the manner of connection to said associated electronic equipment is such that the currents in the corresponding conductors of said two antenna elements are approximately equal in amplitude; and (d) the distance between said antenna elements and the phase difference between the currents in the corresponding conductors are such that the radiation is minimized in one of the two directions perpendicular to said planes of said antenna elements.

30. The antenna system of claim 29 wherein:

(a) the distance between said antenna elements is approximately a free-space quarter wavelength; and (b) the phase difference between said currents in said corresponding conductors is approximately a consistent 90 degrees.

31. The antenna system of claim 24 wherein:

(a) there are just two antenna elements in each of said antennas;

(b) only the rear antenna elements are connected to said associated electronic equipment; and (c) the dimensions of said antenna elements and the distances between said antenna elements are such that the performance of said antenna system is substantially unidirectional to the front of said antenna system.

32. The antenna system of claim 24 wherein:

(a) said approximately parallel conductors of all said antennas are approximately parallel to each other; and (b) said antennas are approximately aligned both in the direction of said planes of said antenna elements and in the direction perpendicular to said approximately parallel conductors.

33. The antenna system of claim 24 wherein:

(a) said approximately parallel conductors of all said antennas are approximately parallel to each other; and (b) said antennas are approximately aligned both in the direction of said planes of said antenna elements and in the direction parallel to said approximately parallel conductors.

34. The antenna system of claim 24 wherein:

(a) said approximately parallel conductors of all said antennas are approximately parallel to each other; and (b) said antennas are approximately aligned in the direction of said planes of said antenna elements and are approximately aligned both in the direction perpendicular to said approximately parallel conductors and in the direction parallel to said approximately parallel conductors, thereby producing a rectangular antenna system.

35. The antenna system of claim 24 wherein the relative amplitude and phase of the currents in said antennas and the distances between said antennas are chosen to maximize the performance of said antenna system to the front of said antenna system.

36. The antenna system of claim 24 wherein the relative amplitude and phase of the currents in said antennas and the distances between said antennas are chosen to minimize the performance of said antenna system in directions other than to the front of said antenna system.

37. The antenna system of claim 24 wherein the relative amplitude and phase of the currents in said antennas and the distances between said antennas are chosen to produce a beneficial compromise between maximizing the performance of said antenna system to the front of said antenna system and minimizing said performance in other directions.

38. The antenna system of claim 24 wherein said antennas are substantially equal to each other in the dimensions of their conductors and the distances between their conductors.

39. The antenna system of claim 38 wherein:

(a) the first half of said antennas has approximately parallel conductors that are oriented perpendicular to said approximately parallel conductors of the second half of said antennas;

(b) said antennas are disposed in pairs, each of said pairs comprising antenna elements having approximately parallel conductors of the two orientations;

(c) said antennas also are disposed so that the centers of the corresponding proximal approximately parallel conductors of each pair of antennas are much closer to each other than the length of a wavelength; and (d) the manner of connection to said associated electronic equipment also is such that the currents in the conductors of said first half of said antennas are approximately equal in amplitude and consistently out of phase by approximately 90 degrees to the currents in the corresponding conductors of said second half of said antennas, thereby producing an approximately circularly polarized antenna system.

40. The antenna system of claim 38 wherein:

(a) the first half of said antennas have approximately parallel conductors that are oriented perpendicular to the approximately parallel conductors of the second half of said antennas;

(b) said antennas are arranged in pairs, each of said pairs comprising antenna elements having approximately parallel conductors of the two orientations;

(c) the centers of said proximal approximately parallel conductors of both antennas, in each of said pairs, are approximately aligned with each other;

(d) the currents in the corresponding conductors of said two antennas, in each of said pairs, are approximately equal in amplitude; and (e) the perpendicular distances between the planes of the corresponding antenna elements in each pair of said antennas and the phase relationship between the corresponding currents in each of said pairs of antennas are such that approximately circularly polarized radiation is produced to the front of said antenna system.

41. The antenna system of claim 24 wherein:

(a) only the second antenna element, counting from the rear, of each of said antennas is connected to the associated electronic equipment; and (b) in each of said antennas, the dimensions of said antenna elements and the distances between said antenna elements are such that the performance of said antenna system is substantially unidirectional to the front of said antenna system.

42. The antenna system of claim 41 wherein the dimensions of said antenna elements and the distances between said antenna elements produce the maximum performance of said antenna system to the front of said antenna system.

43. The antenna system of claim 41 wherein the dimensions of said antenna elements and the distances between said antenna elements produce the minimum performance of said antenna system in directions other than in the direction to the front of said antenna system.

44. The antenna system of claim 41 wherein the dimensions of said antenna elements and the distances between said antenna elements produce a beneficial compromise between maximizing the performance of said antenna system in the direction to the front of said antenna system and minimizing said performance in other directions.

45. The antenna system of claim 24 wherein:

(a) the resonant frequencies of said antenna elements are progressively and proportionally higher from the rear end to the front end of each of said antennas;

(b) the distances between said antenna elements are progressively and proportionally shorter from said rear end to said front end of each of said antennas;

(c) within each of said antennas, the ratio of the resonant frequencies of all the adjacent antenna elements and the ratio of all the adjacent distances between said antenna elements are approximately equal ratios;

(d) within each of said antennas, all of said antenna elements are connected to each other, effectively at the centers of said proximal approximately parallel conductors, so that the phase relationship produced by the time taken for the energy to travel between them by that connection is essentially equal to the phase relationship that is consistent with travel at the speed of light;

(e) said connection between said antenna elements also produces, in addition to the phase difference caused by the travelling time of the energy, an additional phase reversal between said adjacent antenna elements; and (f) said antenna elements at said front end of each of said antennas are connected to the associated electronic equipment.

46. The antenna system of claim 45 wherein the differences in said resonant frequencies are caused by all the dimensions of said antenna elements approximately being proportionally different.

47. The antenna system of claim 45 wherein:

(a) the distances between said approximately parallel conductors within each of said antenna elements are all approximately equal distances; and (b) the differences in said resonant frequencies are caused by the lengths of said approximately parallel conductors being different.

48. The antenna system of claim 45 wherein the method of producing said resonant frequencies is a compromise between having all the dimensions of said antenna elements proportional to each other and having equal distances between said approximately parallel conductors in each of said antenna elements.

* * * * *